US008329056B2

(12) United States Patent
Yamashita et al.

(10) Patent No.: US 8,329,056 B2
(45) Date of Patent: Dec. 11, 2012

(54) ANISOTROPIC RARE EARTH-IRON BASED RESIN BONDED MAGNET

(75) Inventors: Fumitoshi Yamashita, Kitasaku-gun (JP); Osamu Yamada, Kitasaku-gun (JP); Shiho Ohya, Kitasaku-gun (JP)

(73) Assignee: Minebea Co., Ltd., Nagano (JP)

( * ) Notice: Subject to any disclaimer, the term of this patent is extended or adjusted under 35 U.S.C. 154(b) by 240 days.

(21) Appl. No.: 12/853,601

(22) Filed: Aug. 10, 2010

(65) Prior Publication Data

US 2011/0074531 A1 Mar. 31, 2011

(30) Foreign Application Priority Data

Sep. 29, 2009 (JP) ..... 2009-223908

(51) Int. Cl.
*H01F 1/08* (2006.01)

(52) U.S. Cl. ..... 252/62.54; 148/301; 148/302

(58) Field of Classification Search ..... None
See application file for complete search history.

(56) References Cited

U.S. PATENT DOCUMENTS

| | | | | |
|---|---|---|---|---|
| 2007/0246128 | A1* | 10/2007 | Yamashita | 148/301 |
| 2008/0066575 | A1* | 3/2008 | Yang | 75/229 |

FOREIGN PATENT DOCUMENTS

| | | |
|---|---|---|
| JP | A-46-7153 | 12/1971 |
| JP | A-52-54998 | 5/1977 |
| JP | A-56-55503 | 5/1981 |
| JP | A-59-170201 | 9/1984 |
| JP | A-60-128202 | 7/1985 |
| JP | A-61-154112 | 7/1986 |
| JP | A-62-196057 | 8/1987 |
| JP | A-1-234502 | 9/1989 |
| JP | A-2-57663 | 2/1990 |
| JP | A-3-126801 | 5/1991 |
| JP | A-3-211203 | 9/1991 |
| JP | B2-3-62764 | 9/1991 |
| JP | A-5-213601 | 8/1993 |
| JP | A-5-230501 | 9/1993 |

(Continued)

OTHER PUBLICATIONS

Lee et al., "Processing of Neodymium-Iron-Boron Melt-Spun Ribbons to Fully Dense Magnets," *IEEE Transactions on Magnetics*, Sep. 1985, pp. 1958-1963, vol. MAG-21, No. 5.

(Continued)

*Primary Examiner* — John P Sheehan
(74) *Attorney, Agent, or Firm* — Oliff & Berridge, PLC

(57) ABSTRACT

Anisotropic rare earth-iron based resin bonded magnet comprises: [1] a continuous phase including: (1) a spherical $Sm_2Fe_{17}N_3$ based magnetic material covered with epoxy oligomer where its average particle size is 1 to 10 μm, its average aspect ratio $AR_{ave}$ is 0.8 or more, and mechanical milling is not applied after Sm—Fe alloy is nitrided; (2) a linear polymer with active hydrogen group reacting to the oligomer; and (3) additive; and [2] a discontinuous phase being an $Nd_2Fe_{14}B$ based magnetic material coated with the epoxy oligomer where its average particle size is 50 to 150 μm, and its average aspect ratio $AR_{ave}$ is 0.65 or more, further satisfying: [3] the air-gap ratio of a granular compound on the phases is 5% or less; and [4] a composition where crosslinking agent with 10 μm or less is adhered on the granular compound is formed at 50 MPa or less.

9 Claims, 11 Drawing Sheets

FOREIGN PATENT DOCUMENTS

| | | |
|---|---|---|
| JP | A-5-234729 | 9/1993 |
| JP | B2-6-17015 | 3/1994 |
| JP | A-6-151127 | 5/1994 |
| JP | A-7-268632 | 10/1995 |
| JP | A-7-326508 | 12/1995 |
| JP | A-8-143913 | 6/1996 |
| JP | A-8-153613 | 6/1996 |
| JP | A-8-183601 | 7/1996 |
| JP | A-9-157803 | 6/1997 |
| JP | B2-2881409 | 4/1999 |
| JP | A-11-335702 | 12/1999 |
| JP | A-2000-12316 | 1/2000 |
| JP | B2-3092672 | 9/2000 |
| JP | B2-3250551 | 1/2002 |
| JP | B2-3410171 | 5/2003 |
| JP | B2-3463911 | 11/2003 |
| JP | A-2004-115921 | 4/2004 |
| JP | B2-3522207 | 4/2004 |
| JP | A-2004-266093 | 9/2004 |
| JP | B2-3595064 | 12/2004 |
| JP | A-2005-26663 | 1/2005 |
| JP | A-2006-100560 | 4/2006 |

OTHER PUBLICATIONS

Huang et al., "Application of Melt-Spun Nd-Fe-B Bonded Magnet to the Micromotor," *Proceedings of the Eleventh International Rare-Earth Magnets and Their Applications*, 1990, pp. 583-594, Pittsburgh, USA.

Rabin et al., "Recent Developments in NdFeB Powder," *120th Topical Symposium of the Magnetics Society of Japan*, 2001, pp. 23-30.

Hirosawa et al., "Structure and Magnetic Properties of $Nd_2Fe_{14}B$/$Fe_xB$-Type Nanocomposistes Prepared by Strip Casting," *IEEE Transactions on Magnetics*, Jul. 2004, pp. 2883-2885, vol. 40, No. 4.

Davies et al., "Nanophase Pr and Nd/Pr-Based Rare Earth-Iron-Boron Alloys," *Proceedings of the Sixteenth International Workshop on Rare-Earth Magents and Their Applications*, 2000, pp. 485-495, The Japan Institute of Metals.

Tokunaga, "Magnetic Properties of Rare Earth Bonded Magnets," 1988, pp. 575-579, vol. 35 (w/ English-language abstract).

Mukai et al., "Fully-Dense Nd-Fe-B Magnets Prepared From Hot-Rolled Anisotropic Powders," *Proceedings of the Eleventh International Workshop on Rare-Earth Magnets and Their Applications*, Oct. 1990, pp. 72-84, Pittsburgh, USA.

Doser et al., "Pulverizing anisotropic rapidly solidified Nd-Fe-B materials for bonded magnets," *J. Appl. Phys.*, Nov. 15, 1991, pp. 6603-6605, vol. 70, No. 10, American Institute of Physics.

Iriyama, "Anisotropic Bonded NdFeB Magnets Made from Hot-Upset Powders," *Polymer Bonded Magnet*, 2002, Chicago.

Morimoto et al., "Anisotropic $Nd_2Fe_{14}B$-Based Magnet Powder with High Remanence Produced by Modified HDDR Process," *IEEE Transactions on Magnetics*, Sep. 1999, pp. 3253-3255, vol. 35, No. 5.

Mishima et al., "Development of a Co-Free NdFeB Anisotropic Bonded Magnet Produced from the *d*-HDDR Processed Powder," *IEEE Transactions on Magnetics*, Jul. 2001, pp. 2467-2470, vol. 37, No. 4.

Hamada et al., "Development of Nd-Fe-B Anisotropic Bonded Magnet With 27 MGOe," *IEEE Transactions on Magnetics*, Sep. 2003, pp. 2953-2955, vol. 39, No. 5.

Chen et al., "A study on the role of Nb in melt-spun nanocrystalline Nd-Fe-B magnets," *Journal of Magnetism and Magnetic Materials*, 2004, pp. 105-113, vol. 268.

* cited by examiner

ANISOTROPIC RARE EARTH-IRON BASED RESIN BONDED MAGNET

BACKGROUND OF THE INVENTION

1. Field of the Invention

The present invention relates to a rare earth-iron based resin bonded magnet, and more particularly to an anisotropic rare earth-iron based resin bonded magnet with high magnetic properties that will satisfy the following conditions: when coercivity HcJ at a room temperature is approximately 1 MA/m, a squareness (achieved by calculation through Hk/HcJ) at a room temperature is $Hkc/HcJ_{RT}$, and a squareness at a temperature of 100° C. is $Hk/Hc_{100}$, Expression $Hk/HcJ_{RT}<Hk/HcJ_{100}$ is obtainable. Here, Hk is a magnetic field in a demagnetization curve corresponding to remanence. Mr, 90% magnetization. In this anisotropic rare earth-iron based resin bonded magnet, squareness deterioration based on a demagnetization curve at a high temperature can be avoided, and the maximum energy product $(BH)_{max}$ can be 170 kJ/m$^3$ or more.

2. Description of the Related Art

Material types for rare earth-iron based magnet such as $Nd_2Fe_{14}B$ base, $\alpha Fe/Nd_2Fe_{14}B$ base and $Fe_3B/Nd_2Fe_{14}B$ base that are obtainable through rapid solidification, for example, a melt spinning method, are limited to a thin strip such as a ribbon, or powder obtained by milling the thin strip. Accordingly, for obtaining a bulked magnet applicable to a compact rotary machine, there will be necessary to conduct material transformation, that is, solidifying the thin strip or the powder into specific bulks with some measures. A primary measures to solidify the powder by means of powder metallurgy is pressureless sintering. However, it is not easy to apply the pressureless sintering to magnetic materials while maintaining their magnetic properties in a metastable condition. Based on the above, the thin strip or the powder has been solidified into specific bulks through binding materials such as epoxy resin, being able to obtain so-called resin bonded magnets.

For example, in 1985, R. W. Lee et al. reported that an isotropic $Nd_2Fe_{14}B$ based bonded magnet with a $(BH)_{max}$ of 72 kJ/m$^3$ is obtainable in such a manner that a thin strip with a $(BH)_{max}$ of 111 kJ/m$^3$ is solidified with resin (see Non-Patent Document 1).

In 1986, the present inventors have proved through the Non-Patent Document 1 that an annular isotropic $Nd_2Fe_{14}B$ magnet with a $(BH)_{max}$ of up to 72 kJ/m$^3$ where the thin strip is solidified with epoxy resin is practicable to compact rotary machines. Further, for example, in 1990, G. X. Huang et al. have proved practicability of an isotropic resin bonded magnet to compact rotary machines (see Non-Patent Document 2), and in the 1990's such a isotropic resin bonded magnet has been widely become known as an annular magnet for a high-performance compact rotor machine applicable to an electromagnetic driving device in electric and electronic equipment such as OA (office automation), AV (audio and visual), PC (personal computer), PC peripheral devices, and telecommunication equipment.

On the other hand, starting from the 1980's, extensive researches on magnetic materials in a melt spinning method have been conducted. Accordingly, $Nd_2Fe_{14}B$ based materials, $Sm_2Fe_{17}N_3$ based materials, or nanocomposite materials through exchange coupling with $\alpha Fe$ based or $Fe_3B$ based materials based on the forenamed materials ($Nd_2Fe_{14}B$ based and $Sm_2Fe_{17}N_3$ based materials) have become publicly known. Further, in addition to diversified alloy compositions or materials where the structure of the alloy compositions is subjected to fine-control, magnetic materials in different shapes obtainable by a rapid solidification method other than the melt spinning method became also known in recent (see for example, Non-Patent Documents 3 and 4). Also, Davies et al. reported magnetic materials where a $(BH)_{max}$ is reachable up to 220 kJ/m$^3$ even though the magnetic materials are isotropic (see Non-Patent Document 5). However, it is speculated that the $(BH)_{max}$ of industrial applicable strips through the rapid solidification method is up to 134 kJ/m$^3$, and the $(BH)_{max}$ of an isotropic resin bonded magnet where the stripes are solidified with resin at 0.8 to 1.0 GPa can be estimated approximately up to 80 kJ/m$^3$.

Regardless of the above, considering electromagnetic driving devices such as relatively compact rotary machines to which the present invention relates, along with the high performability of electrical and electric equipments, demands for further miniaturization, high-output and high efficiency have never been ceased. Thus, it is obvious that just improving the magnetic properties of magnetically isotropic strips through the rapid solidification method is no longer enough for catching up with the enhancing performance of electric and electronic equipment. Accordingly, necessity has been further focused on a magnet generating static magnetic fields in which to fit the most preferable magnetic circuits for the iron core of the rotary machines (preferably, magnets that generate further strong static magnetic fields per unit volume).

Here, considering Sm—Co based magnetic materials applied for a rare-earth magnet, it is possible to obtain high coercivity (HcJ) even though ingots have been milled. However, the application of Co has problems in its stable supply due to a fragile resource balance and so on. It would be thus not suitable to apply Co as general-purpose industrial materials. On the other hand, rare earth-iron based magnetic materials that are mostly based on Fe as well as rare-earth elements such as Nd, Pr and Sm are advantageous in stable resource supplies of a resource balance. However, only a limited HcJ is obtainable even if the ingots of $Nd_2Fe_{14}B$ based alloy or sintering magnets are milled. Accordingly, for producing anisotropic $Nd_2Fe_{14}B$ based magnetic materials, researches where melt spinning materials are applied as starting materials were advanced.

In 1989, Tokunaga obtained an anisotropic magnet with a $(BH)_{max}$ of 127 kJ/m$^3$ in such a manner as that a bulk where $Nd_{14}Fe_{80-X}B_6Ga_X$ (X=0.4 to 0.5) is subjected to hot upsetting (die-upset) is milled so as to form anisotropic $Nd_2Fe_{14}B$ based magnetic materials where HcJ=1.52 MA/m, and the magnetic materials are then solidified with resin (see Non-Patent Document 6). Also, in 1991, H. Sakamoto et al. obtained anisotropic $Nd_2Fe_{14}B$ based magnetic materials where HcJ=1.30 MA/m in such a manner as that $Nd_{14}Fe_{79.8}B_{5.2}Cu_1$ is subjected to hot rolling (see Non-Patent Document 7). Accordingly, high HcJ (coercive) magnetic materials become publicly available while hot processing treatments are improved with addition of Ga and Cu, and the refinement of an $Nd_2Fe_{14}B$ crystal particle size is further advanced.

In 1991, V. Panchanathan et al. obtained a resin bonded magnet with a $(BH)_{max}$ of 150 kJ/m$^3$ through a hot mill method, specifically as that the invasion of hydrogen is made from a grain boundary so as to make a bulk collapsed as $Nd_2Fe_{14}BH_X$, and then HD (hydrogen decrepitation) —$Nd_2Fe_{14}B$ magnetic materials that have been dehydrogenated by vacuum heating are extracted. Finally, the magnetic materials are solidified by resin (see Non-Patent Document 8). In 2001, through the same method, Iriyama obtained a modified anisotropic magnet with a $(BH)_{max}$ of 177 kJ/m$^3$ by making $Nd_{0.137}Fe_{0.735}CO_{0.067}B_{0055}Ga_{0.006}$ into magnetic materials and then solidified with resin (see Non-Patent Document 9).

Then, in 1999, a resin bonded magnet with a $(BH)_{max}$ of 193 kJ/m$^3$ is obtained in such a manner that an Nd—Fe (Co)—B ingot is heat-treated in hydrogen atmosphere such that: $Nd_2(Fe, Co)_{14}B$ phase is hydrogenated (hydrogenation, $Nd_2(Fe, Co)_{14}BH_x$); the phase is decomposed at 650 to 1000° C. (decomposition, $NdH_2$+Fe+$Fe_2B$); hydrogen is desorbed (desorption); and recombination is performed (recombination). Finally, HDDR $Nd_2Fe_{14}B$ based magnetic materials are solidified with resin at 1 GPa (see Non-Patent Document 10).

In 2001, Mishima et al. reported Co-free d-HDDR $Nd_2Fe_{14}B$ based magnetic materials (see Non-Patent Document 11), and N. Hamada et al. obtained a cubic anisotropic magnet (7 mm×7 mm×7 mm) with a density of 6.51 Mg/m$^3$ and a $(BH)_{max}$ of 213 kJ/m$^3$ in such a manner that d-HDDR $Nd_2Fe_{14}B$ based magnetic materials with a $(BH)_{max}$ of 358 kJ/m$^3$ are compressed together with resin at 0.9 GPa and at temperature of 150° C. in orientation magnetic field of 2.5 T (see Non-Patent Document 12).

<Patent Document>

<Patent Document 1> Patent Application No. Sho 62-196057

<Non-Patent Documents>

<Non-Patent Document 1> R. W. Lee, E. G Brewer, N. A. Schaffel, "PROCESSING OF NEODYMIUM-IRON-BORON MELT-SPUN RIBBONS TO FULLY DENSE MAGNETS" IEEE Trans. Magn., Vol. 21, 1985

<Non-Patent Document 2> G. X. Huang, W. M. Gao, S. F. Yu, "Application of Melt-spun Nd—Fe—B Bonded magnet to the Micromotor", Proc. of the 11th International Rare-Earth Magnets and Their Applications, Pittsburgh, USA, pp. 583-594 (1990)<

<Non-Patent Document 3> B. H. Rabin, B. M. Ma, "Recent developments in NdFeB Powder", 120th Topical Symposium of the Magnetics Society of Japan, pp. 23-30 (2001)<

<Non-Patent Document 4> S. Hirosawa, H. Kanekiyo, T. Miyoshi, K. Murakami, Y. Shigemoto, T. Nishiuchi, "Structure and Magnetic properties of $Nd_2Fe_{14}B/Fe_xB$-type nanocomposites prepared by Strip casting", 9th Joint MMM/INTERMAG, CA (2004) FG-05

<Non-Patent Document 5> H. A. Davies, J. I. Betancourt R. and C. L. Harland, "Nanophase Pr and Nd/Pr-based Rare Earth-Iron-Boron Alloys", Proc. of 16th Int. Workshop on Rare-Earth Magnets and Their Applications, Sendai, pp. 485-495 (2000)<

<Non-Patent Document 6> G. Tokunaga, "Magnetic Characteristic of Rare-Earth Bond Magnets, Magnetic Powder and Powder Metallurgy", Vol. 35, pp. 3-7 (1988)<

<Non-Patent Document 7> T. Mukai, Y. Okazaki, H. Sakamoto, M. Fujikura and T. Inaguma, "Fully-dense Nd—Fe—B Magnets prepared from hot-rolled anisotropic powders", Proc. 11th Int. Workshop on Rare-Earth Magnets and Their Applications, Pittsburgh, pp. 72-84 (1990)<

<Non-Patent Document 8> M. Doser, V. Panchanacthan, and R. K. Mishra, "Pulverizing anisotropic rapidly solidified Nd—Fe—B materials for bonded magnets", J. Appl. Phys., Vol. 70, pp. 6603-6605 (1991)<

<Non-Patent Document 9> T. Iriyama, "Anisotropic bonded NdFeB magnets made from Hot-upset powders", Polymer Bonded Magnet 2002, Chicago (2002)<

<Non-Patent Document 10> K. Morimoto, R. Nakayama, K. Mori, K. Igarashi, Y. Ishii, M. Itakura, N. Kuwano, K. Oki, "Anisotropic $Nd_2Fe_{14}B$-based Magnet powder with High remanence produced by Modified HDDR process", IEEE. Tran. Magn., Vol. 35, pp. 3253-3255 (1999)<

<Non-Patent Document 11> C. Mishima, N, Hamada, H. Mitarai, and Y. Honkura, "Development of a Co-free NdFeB Anisotropic bonded magnet produced from the d-HDDR Processed powder", IEEE. Trans. Magn., Vol, 37, pp. 2467-2470 (2001)

<Non-Patent Document 12> N. Hamada, C. Mishima, H. Mitarai and Y. Honkura, "Development of Nd—Fe—B Anisotropic Bonded Magnet with 27 MGOe" IEEE. Trans. Magn., Vol. 39, pp. 2953-2955 (2003)<

<Non-Patent Document 13> Z. Chena, Y. Q. Wub, M. J. Kramerb, B. R. Smith, B. M. Ma, M. Q. Huang, "A study on the role of Nb in melt-spun nanocrystalline Nd—Fe—B magnets', J., Magnetism and Magn., Mater., 268. pp. 105-113 (2004)"

Considering resin bonded magnets where the above descried anisotropic rare earth-iron based magnetic materials are solidified with resin at 0.9 GPa, for example, it is possible to gain the magnetic property of a $(BH)_{max}$ that is more than as twice as an isotropic resin bonded magnet with 80 kJ/m$^3$. However, for adapting the anisotropic resin bonded magnets to rotary machines, it would be necessary to satisfy magnetic stability such as demagnetizing strength against irreversible demagnetization or demagnetizing fields.

Here, compared to the grain size 15-20 nm of an isotropic $Nd_2Fe_{14}B$ based magnetic material obtained through a rapid-solidified thin strip (for example, see Non-Patent Document 13), an anisotropic $Nd_2Fe_{14}B$ based magnetic material obtained through either the milling of hot-worked bulks or HDDR treatments has the grain size of 200 to 500 nm which is the texture of a $Nd_2Fe_{14}B$ crystal that is one digit larger than the isotropic $Nd_2Fe_{14}B$ based magnetic materials.

In case that the grain size of $Nd_2Fe_{14}B$ is, for example, 15 to 20 nm, magnetic properties (including magnetic stability), such as remanence $Mr_p$ based on remanence enhancement effects or temperature coefficient $\beta_p$%/° C. of coercivity HcJp, are improved. In addition, the magnetic properties such as $HcJ_p$ or $(BH)_{maxp}$ of the magnetic materials would be not prominently deteriorated even if the particle size becomes lessened approximately to, for example, 40 μm.

That is, in case that the grain size of $Nd_2Fe_{14}B$ is, for example, 15 to 20 nm, at the stage where the materials are compressed with resin, for example, at 0.8 to 1.0 GPa so as to obtain resin bonded magnets in a specific form, it would be inevitable that the surface of the magnetic material are damaged or fractured. However, the magnetic property deterioration of the magnetic materials is within a range that can be actually ignored.

Here, when considering $Nd_2Fe_{14}B$ based magnetic materials where hot-worked bulks with a $Nd_2Fe_{14}B$ grain size of 200 to 500 nm are milled, or anisotropic resin bonded magnets where HDDR-$Nd_2Fe_{14}B$ based magnetic materials are solidified with resin at 0.8 to 1.0 GPa, occurrence of newly created surfaces or microcracks would be inevitable due to the damage or breakage of the surface of magnetic materials through densification. Accordingly, $Nd_2Fe_{14}B$ crystals formed on the most outer surface of the magnetic materials are oxidized so as to cause texture evolution, whereby magnetic properties based on $HcJ_p$, $(BH)_{maxp}$, etc. may be deteriorated. The treatment deterioration of the magnetic properties of the anisotropic $Nd_2Fe_{14}B$ based magnetic materials is obvious compared to the isotropic $Nd_2Fe_{14}B$ based magnetic materials. Thus, in order to suppress the deterioration of the magnetic properties occurring when the anisotropic $Nd_2Fe_{14}B$ based magnetic materials are densified, it would be necessary to reduce or modify pressures toward the magnetic materials through the densification.

On the other hand, considering magnetic materials that have a nucleation-typed coercive generation mechanism which is typical in $SmCo_S$ base or $Sm_2Fe_{17}N_3$ base, they generally need a particle size of 10 μm or less. As to resin bonded magnets where these magnetic materials with such a small particle size are compressed with resin, it would be difficult to make their densities to be 5 $Mg/m^3$ or more (relative density: 65%). Accordingly, these resin bonded magnets are generally used as an injection-molded resin bonded magnet. Therefore, compared to an isotropic $Nd_2Fe_{14}B$ based resin bonded magnet with a $(BH)_{max}$ of approximately 80 $kJ/m^3$ where an isotropic $Nd_2Fe_{14}B$ based magnetic materials are milled and solidified with resin at 0.8 to 1 GPa, the advantage of $(BH)_{max}$ is far behind, largely lowered than the $(BH)_{max}$ of an anisotropic $Nd_2Fe_{14}B$ based resin bonded magnet.

It can be therefore said that these technical problems discussed hereinabove could be one of the factors which hampers an anisotropic rare earth-iron based resin bonded magnet from being applied to electromagnetic driving devices such as rotary machines although the anisotropic rare earth-iron based resin bonded magnet is regarded as the next generation type of the isotropic $Nd_2Fe_{14}B$ based resin bonded magnet with a $(BH)_{max}$ of 80 $kJ/m^3$.

SUMMARY OF THE INVENTION

The present invention has been made in view of the circumstances described above, and it is an object of the present invention to provide an anisotropic rare earth-iron based resin bonded magnet that can be a next generation type for isotropic $Nd_2Fe_{14}B$ based resin bonded magnets with $(BH)_{max}$ of 80 $kJ/m^3$, contributing to miniaturization and a high mechanical output power of rotary machines.

In order to achieve the object described above, according to an aspect of the present invention, there is provided an anisotropic rare earth-iron based resin bonded magnet comprising:

[1] a continuous phase including: (1) a spherical $Sm_2Fe_{17}N_3$ based magnetic material where an average particle size and an average aspect ratio $AR_{ave}$ of the magnetic material are 1 to 10 μm and 0.8 or more, respectively, in a condition that AR is b/a when the maximum diameter of a particle image is "a" while the maximum diameter perpendicular to the "a" is "b", and mechanical milling is not applied after an Sm—Fe alloy is nitrided, the spherical $Sm_2Fe_{17}N_3$ based magnetic material being covered with solid epoxy oligomer at a room temperature; and (2) a linear polymer that has an active hydrogen group in which to react to the oligomer; and

[2] a discontinuous phase being defined by an $Nd_2Fe_{14}$13 based magnetic material where an average particle size and an average aspect ratio $AR_{ave}$ of the magnetic material are 50 to 150 μm, and its average aspect ratio $AR_{ave}$ and 0.65 or more, respectively, the $Nd_2Fe_{14}B$ based magnetic material being covered with solid epoxy oligomer at a room temperature, the anisotropic rare earth-iron based resin bonded magnet further satisfying the following:

[3] a volume fraction of void in the material including continuous and discontinuous phases is 5% or less; and

[4] the material including continuous phase and discontinuous phase having a crosslinking agent with an average particle size of 10 μm or less is compacted into a specific shape through a magnetic field press at 50 MPa or less.

In an anisotropic rare earth-iron based resin bonded magnet according to the present invention, for improving magnetic stability such as irreversible demagnetization or demagnetizing proof stress against reverse magnetic fields at a high temperature, and magnetic properties typically defined by a $(BH)_{max}$, the following conditions should be established. When the coercivity of $Sm_2Fe_{17}N_3$ based magnetic materials is set to $HcJp_S$, the coercivity of $Nd_2Fe_{14}B$ based magnetic materials at a room temperature is set to $HcJp_N$, and a ratio between $HcJp_S$ and $HcJp_N$ ($HcJp_S/HcJp_N$) is set to α, $HcJp_N$ is 1 to 1.25 MA/m, and $HcJp_S$ is equal to or less than $HcJp_N$ ($HcJp_S<HcJp_N$). Further, α should be 0.75 or less, or more preferably 0.65 or less.

Based on the above, according to the present invention, when the symbols $Mr_m$, $Mr_p$ and $Vf_p$ are remanence of the resin bonded magnet, remanence of the mixed $Sm_2Fe_{17}N_3$ and the $Nd_2Fe_{14}B$ magnetic material, and a volume fraction of magnetic material in the resin bonded magnet, respectively, it is possible that the orientation degree $Mr_m/(Mr_p \times Vf_p)$ of the magnetic materials can be set to 0.96 or more, and a $(BH)_{max}$ can be set to 170 $kJ/m^3$ or more in a condition that α is 0.75 or less, and $Vf_p$ is equal to or greater than 80 vol. % ($Vfp \geqq 80$ vol. %). Further, in a condition that α is 0.65 or less, and $Vf_p$ is equal to or greater than 80 vol. % ($Vf_p \geqq 80$ vol. %), the orientation degree $Mr_M/(Mr_p \times Vf_p)$ can be set to 0.98 or more, and a $(BH)_{max}$ can be set to 180 $kJ/m^3$ or more.

Moreover, in case that the squareness of a demagnetization curve of the anisotropic rare earth-iron based resin bonded magnet at a room temperature according to the present invention is set to $Hk/HcJ_{RT}$, and squareness at 100° C. is set to $Hk/HcJ_{100}$, it is preferable to establish that $Hk/HcJ_{RT}$ is less than $Hk/HcJ_{100}$ ($Hk/HcJ_{RT}<Hk/HcJ_{100}$). Here, Hk is a magnetic field in a demagnetization curve corresponding to 90% of remanence Mr, HcJ is coercivity, and squareness is calculated from Hk/HcJ.

In the anisotropic rare earth-iron based resin bonded magnet according to the present invention, when considering the structure of rotary machines that can effectively secure magnetic stability and can employ air-gap magnetic flux density between a magnet and an iron core (that is, a magnetic circuit structure between the iron core and the magnet), it is preferable to establish that permeance coefficient Pc is 3 or more.

As discussed hereinabove, the anisotropic rare earth-iron based resin bonded magnet according to the present invention can be structured as that the squareness of the demagnetization curve at a high temperature based on $Hk/HcJ_{RT}<Hk/HcJ_{100}$ is not deteriorated. Further, since the anisotropic rare earth-iron based resin bonded magnet according to the present invention also has high magnetic properties where the maximum energy product $(BH)_{max}$ is 170, or more than 180 $kJ/m^3$, it would be applicable as the next generation type of an isotropic $Nd_2Fe_{14}B$ based resin bonded magnet with a $(BH)_{max}$ of 80 $kJ/m^3$, contributing to make the rotary machines to be further miniaturized and to have higher mechanical output.

A resin bonded magnet satisfying the following conditions is going to be considered:

<1> A continuous phase is composed of: (1) a spherical $Sm_2Fe_{17}N_3$ based magnetic material that has an average aspect ratio $AR_{ave}$ of 0.80 or more and is covered with epoxy oligomer; (2) a linear polymer having an active hydrogen reactive group that can react to the oligomer; and (3) an additive to be properly added when necessary;

<2> a discontinuous phase is $Nd_2Fe_{14}B$ based magnetic materials that are covered with epoxy oligomer;

<3> the air-gap ratio of a granular compound existed in the continuous and discontinuous phases is set to 5% or less; and <4> a composition, in which crosslinking agents made of impalpable powder are adhered on the surface of the granular compound, is produced through a magnetic field pressing at 50 MPa or less.

In the above conditions, when the coercivity of $Sm_2Fe_{17}N_3$ based components is set to $HcJp_S$, the coercivity of $Nd_2Fe_{14}B$ based components is set to $HcJp_N$, and their ratio ($HcJp_S/HcJp_N$) is set to $\alpha$, $HcJp_N$ can be set to 1 to 1.25 MA/m while $HcJp_S$ can be equal to or less than $HcJp_N$ ($HcJp_S \leqq HcJp_N$). Further, in case that the remanence of resin bonded magnets is set to $Mr_M$, the remanence of magnetic materials is set to $Mr_p$, and the volume fraction of the magnetic materials is set to $Vf_p$, the following is established: $Vf_p$ is equal to or greater than 80 vol. % ($Vf_p \geqq 80$ vol. %), $Mr_M/(Mr_p \times Vf_p)$ is 0.96 or more where $\alpha$ is 0.75 or less, and a $(BH)_{max}$ is 170 kJ/m$^3$ or more. Still further, when $Vf_p$ is equal to or greater than 80 vol. % ($Vf_p \geqq 80$ vol. %), and $\alpha$ is 0.65 or less, the following is established: $Mr_M/(Mr_p \times Vf_p)$ is 0.98 or more, and a $(BH)_{max}$ is 180 kJ/m$^3$ or more. In addition, when the squareness of the resin bonded magnets at a room temperature is set to $Hk/HcJ_{RT}$, and the squareness at a temperature of 100° C. is set to $Hk/HcJ_{100}$, it is possible to establish that $Hk/HcJ_{RT}$ is less than $Hk/HcJ_{100}$ ($Hk/HcJ_{RT} < Hk/HcJ_{100}$).

As discussed hereinabove, in an anisotropic rare earth-iron based resin bonded magnet according to the present invention, when the coercivity HcJ at a room temperature is approximately 1 MA/m or more, the squareness at a room temperature is $Hk/HcJ_{RT}$, and the squareness at a temperature of 100° C. is $Hk/HcJ_{100}$, $Hk/HcJ_{RT}$ will be less than $Hk/HcJ_{100}$ ($Hk/HcJ_{RT} < Hk/HcJ_{100}$). Accordingly, the squareness of demagnetization curve will not be deteriorated at a high temperature, magnetic stability can be well secured, and the maximum energy product $(BH)_{max}$ can be 170 kJ/m$^3$ or more. Here, when considering rotary machines (meaning a magnetic circuit structure between an iron core and a magnet) that can effectively secure the magnetic stability and can employ the air-gap magnetic flux density of the anisotropic rare earth-iron based resin bonded magnet according to the present invention, it is preferable that permeance coefficient Pc is 3 or more.

DETAILED DESCRIPTION OF THE INVENTION

Figure 1:
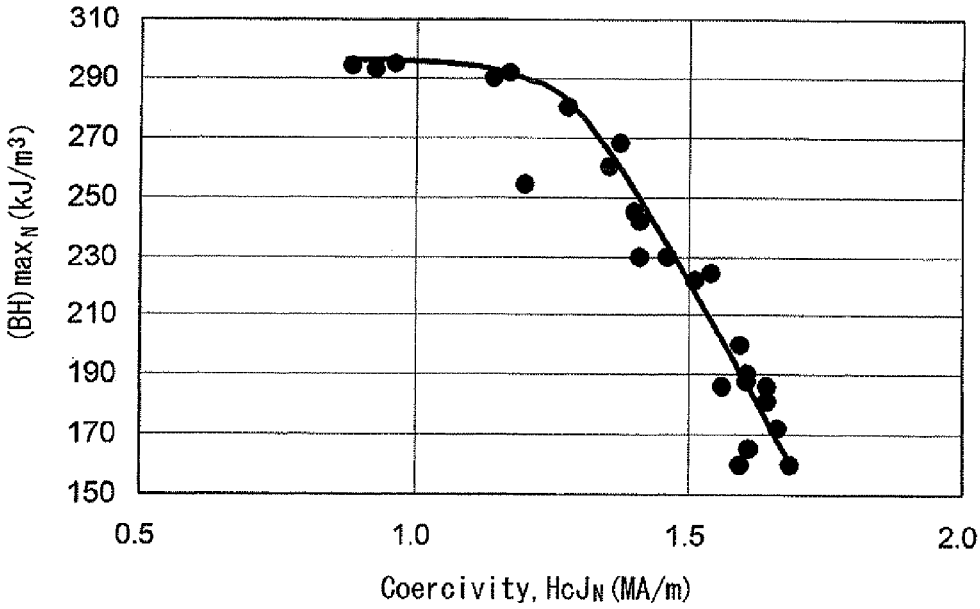
FIG. 1 is a chart indicating a relation between the coercivity $HcJp_N$ and $(BH)_{maxPN}$ of an $Nd_2Fe_{14}B$ based magnetic materials.

First, in terms of a continuous phase according to the present invention, spherical $Sm_2Fe_{17}N_3$ based magnetic materials will be explained hereinafter. The spherical $Sm_2Fe_{17}N_3$ based magnetic materials satisfy the following condition as that: its average particle size is 1 to 10 μm, its average aspect ratio $AR_{ave}$ is 0.80 or more; and mechanical milling is not conducted following the nitriding of Sm—Fe alloy. Further, the above spherical $Sm_2Fe_{17}N_3$ based magnetic materials are covered with solid epoxy oligomer at a room temperature.

The $Sm_2Fe_{17}N_3$ based magnetic materials may be formed with the following method: a melt casting method disclosed by Japanese Patent Application Laid-Open No. Hei 2-57663, or a reduction/diffusion method disclosed by Japanese Patent Application Laid-Open No. S61-295308 or Japanese Patent Application Laid-Open No. Hei 9-157803. These methods are performed as that: an Sm—Fe based alloy or an Sm—(Fe, Co) based alloy is produced; and the alloy is nitrided and then mechanically milled so as to be reduced into a particle size.

Considering the spherical $Sm_2Fe_{17}N_3$ based magnetic material where its average particle size is 1 to 10 μm, and its average aspect ratio $AR_{ave}$ is 0.80 or more, after an $Sm_2Fe_{17}$ alloy is nitrided, mechanical milling means such as jet mill, vibration ball mill or rotation ball mill are not conducted. This is due to a reason that micronized powder, which is inevitably produced through mechanical milling, will never exist.

As to a specific method that can produce the $Sm_2Fe_{17}N_3$ based magnetic materials where the mechanical milling means is not applied following the nitriding of the $Sm_2Fe_{17}$ alloy, the following method can be introduced: impalpable powder such as an Sm—Fe based alloy or an Sm—(Fe, Co) based alloy is produced based on a molten alloy through a gas-atomized method, and then the impalpable powder is nitrided. Accordingly, without conducting the mechanical milling following nitriding, it is possible to obtain the $Sm_2Fe_{17}N_3$ based magnetic materials according to the present invention.

Further, as shown in Japanese Patent Application Laid-Open No. Hei 6-151127, it is possible to obtain the $Sm_2Fe_{17}N_3$ based magnetic material according to the present invention which is not necessary for mechanical milling following nitriding in such a manner that carbonyl iron is applied, and the temperature of the reduction/diffusion method used for the reduction of an rare-earth element is set within 650 to 880° C.

Still further, in Japanese Patent Application Laid-Open No. Hei 11-335702, for example, $Sm_2O_3$ with an average particle size of 35 μm and $Fe_2O_3$ with an average particle size of 1.3 μm are mixed with Sm (11% at atomic percent) and Fe (89.0% at atomic percent), and then milled and blended through wet milling to obtain dried, blended powder. The blended powder is then preheated at 600° C. in hydrogen flow for 4 hours so as to reduce the iron oxide into metals with an average particle size of 2 to 3 μm. The reduced blended powder is then mixed with Ca particles and heated at 1000° C. in an Ar atmosphere for one hour. After conducting the diffusion/reduction treatments, nitriding at 450° C. for 2 hours is performed. Lastly, rinsing and dehydrated drying are performed. Accordingly, the $Sm_2Fe_{17}N_3$ based magnetic material can be obtained without conducting mechanical milling following nitriding.

In addition, Japanese Patent Application Laid-Open No. 2004-115921 discloses a sol-gel method enabling to obtain the $Sm_2Fe_{17}N_3$ based magnetic material without conducting mechanical milling. In the sol-gel method, Sm and Fe are dissolved in acid, and materials generating salt that is insoluble in Sm ion and Fe ion are precipitated through solution reaction. The precipitated materials are then calcined so as to obtain metallic oxide.

Still further, Japanese Patent Application Laid-Open No. 2004-115921 also discloses the sol-gel method. In the method, Sm and Fe, are dissolved in acid, and materials that produce salt insoluble in Sm ion and Fe ion are precipitated through a solution reaction. The precipitated materials are then calcined producing metallic oxide. For example, from Sm ion or Fe ion solution, materials that produce salt insoluble in the metallic ion will be supplied. Oxalic acid may be supplied as a material that provides hydroxide ion. In these organic solvents of metal alkoxide, addition of water can separate out metal hydroxide, the metal hydroxide being precipitated. The metallic oxide obtained as discussed above is then reduced so as to obtain fine $Sm_2Fe_{17}$ alloy powder which is then nitrided. Based on the above, it is possible to obtain the $Sm_2Fe_{17}N_3$ based magnetic materials without conducting mechanical milling.

Accordingly, the present invention can provide the spherical $Sm_2Fe_{17}N_3$ based magnetic material where, among the $Sm_2Fe_{17}N_3$ based magnetic materials that are produced without mechanical milling after nitriding Sm—Fe alloy, its average particle size is 1 to 10 μm, and its average aspect ratio $AR_{ave}$ is 0.80 or more. With the spherical $Sm_2Fe_{17}N_3$ based magnetic materials, it would be possible to eliminate micronized powder that is inevitably produced by mechanical milling.

Here, in the present invention, the micronized powder means a particle size less than 1 μm (exclusive). As disclosed in Japanese Patent Application Laid-Open No. 2000-12316, the micronized powder of this size will negatively influence the magnetic properties of the $Sm_2Fe_{17}N_3$ based magnetic material. However, by applying a temperature history of 50° C. or more that will be necessary for resin bonded magnets to be a specific form, the micronized powder with a particle size less than 1 μm (exclusive) will be disappeared. Accordingly, only the $Sm_2Fe_{17}N_3$ based magnetic material with a particle size of 1 μm or more (providing no negative influence) will exist and satisfactorily deal with the determined magnetic properties of the resin bonded magnet.

In the spherical $Sm_2Fe_{17}N_3$ based magnetic material according to the present invention, it would be possible to have multiple surface treatments (more than one time). Specifically, the surface formation of a de-oxidation film is disclosed by Japanese Patent Publication Laid-Open No. Sho 52-54998, Japanese Patent Publication Laid-Open No. Sho 59-170201, Japanese Patent Publication Laid-Open No. Sho 60-128202, Japanese Patent Publication Laid-Open No. Hei 3-211203, Japanese Patent Publication Laid-Open No. Sho 46-7153, Japanese Patent Publication Laid-Open No. Sho 56-55503, Japanese Patent Publication Laid-Open No. Sho 61-154112, Japanese Patent Publication Laid-Open No. Hei 3-126801, etc. Further, the surface formation of a metallic film is disclosed by Japanese Patent Publication Laid-Open No. Hei 5-230501, Japanese Patent Publication Laid-Open No. Hei 5-234729, Japanese Patent Publication Laid-Open No. Hei 8-143913, Japanese Patent Publication Laid-Open No. Hei 7-268632, etc. Still further, the surface formation of an inorganic film is disclosed by Examined Patent Publication No. Hei 6-17015, Japanese Patent Publication Laid-Open No. Hei 1-234502, Japanese Patent Publication Laid-Open No. Hei 4-6-17015, Japanese Patent Publication Laid-Open No. Hei 5-213601, Japanese Patent Publication Laid-Open No. Hei 7-326508, Japanese Patent Publication Laid-Open No. Hei 8-153613, Japanese Patent Publication Laid-Open No. Hei 8-183601, etc.

Here, in the spherical $Sm_2Fe_{17}N_3$ based magnetic material according to the present invention where no mechanical milling means is applied following nitriding, it would be necessary to have a solid epoxy oligomer layer on the most outer surface thereof at a room temperature. As to the preferable example of the epoxy oligomer, an o-cresol novolac epoxy oligomer can be, for example, named where epoxy equivalent is 205 to 220 g/eq, a melting point is 70 to 76° C., and the suitable thickness of the layer is 30 to 100 nm. Here, if the thickness of the layer is less than 30 nm (exclusive), the fixing strength of the spherical $Sm_2Fe_{17}N_3$ based magnetic material will be decreased. On the other hand, if 100 nm or more, a $(BH)_{max}$ will be decreased along with the increase of the volume fraction of non-magnetic materials.

Next, a continuous phase according to the present invention that is composed of: a linear polymer having active hydrogen groups that may react to a sold epoxy oligomer coated on the spherical $Sm_2Fe_{17}N_3$ based magnetic material at a room temperature; and an additive which is added in when necessary will be hereinafter explained.

Considering the linear polymer constructing the continuous phase of the present invention, for example, a polyamide-12 where a number-average molecular weight Mn is 4000 to 12000 or its copolymer can be named. Further, as to the additive which is properly added in when necessary, the following are preferably named as internal lubricant: a hydrophilic functional group that accelerates external elusion from a molten linear polymer when the magnetic materials are densified; and organic compounds where at least one long-chain alkyl group for producing internal lubricating effects is included per molecule and a melting point is approximately 50° C. or more. Specifically, one hydroxyl group (—OH) per molecule, or organic compounds with 3 heptadecyl groups ($—(CH_2)_{16}—CH_3$) of carbon number 17 may be exemplified.

Next, an $Nd_2Fe_{14}B$ based magnetic material where its discontinuous phase is coated with a solid epoxy oligomer at a room temperature, its average particle size is 50 to 150 μM, and its average aspect ratio $AR_{ave}$ 0.65 or more will be explained. Further, the reason that the air-gap ratio of a granular compound on the continuous and discontinuous phases is set to 5% or less will be also explained.

The $Nd_2Fe_{14}B$ based magnetic material according to the present invention where its average particle size 50 to 150 μm while its average aspect ratio $AR_{ave}$ is 0.65 or more may suitably be a so-called Hydrogenation, Disproportionation, De-sorption, and Re-combination HDDR-$N_2Fe_{14}B$ based magnetic materials or Co-free d-HDDR-$R_2Fe_{14}B$ based magnetic materials, these magnetic materials being disclosed by Japanese Patent No. 3092672, Japanese Patent No. 2881409, Japanese Patent No. 3250551, Japanese Patent No. 3410171, Japanese Patent No. 3463911, Japanese Patent No. 3522207, Japanese Patent No. 3595064, etc. The HDDR discussed hereinabove is performed as that: $R_2(Fe, Co)_{14}B$ based alloy (R is Nd, Pr) is hydrogenated (Hydrogenation, $R_2(Fe, Co)_{14}B$ Hx), a phase decomposition is performed at a temperature of 650 to 1000° C. (Decomposition, $RH_2+Fe+Fe_2B$), dehydrogenation is performed (Desorption), and recombination is finally performed (Recombination). Here, as disclosed by Japanese Patent Publication Laid-Open No, 2004-266093, Japanese Patent Publication Laid-Open No. 2005-26663, Japanese Patent Publication Laid-Open No, 2006-100560, etc., it could be alternated by the magnetic materials that have predetermined surface treatments.

Considering the $Nd_2Fe_{14}B$ based magnetic materials where hot-working bulks are milled by means of a mechanical means, an anisotropic $Nd_2Fe_{14}B$ grain is flat, and the materials that are mechanically milled can be structured in many cases that its thickness direction is correspondent with a C axial direction. That is, the magnetic material will have a shape magnetic anisotropy that is perpendicular to the C axis whereby it would be difficult to obtain the average particle size of 50 to 150 μm, and the average aspect ratio $Al_{ave}$ of 0.65 or more.

As discussed, the $Nd_2Fe_{14}B$ based magnetic material according to the present invention where its average particle size is 50 to 150 μm, and its average aspect ratio $AR_{ave}$ is 0.65 or more will need to have a solid epoxy oligomer at a room temperature that is coated on the most outer surface thereof. Here, it would be preferable that the coated layer is approximately 30 to 100 nm. Here, if the thickness of the coated layer is less than 30 nm (exclusive), the fixing strength of the spherical $Sm_2Fe_{17}N_3$ based magnetic material will be decreased. On the other hand, if 100 nm or more, magnetization and a $(BH)_{max}$ will be decreased along with increase of the volume fraction of non-magnetic materials.

As discussed, in the present invention,

<1> a continuous phase includes: (1) a spherical $Sm_2Fe_{17}N_3$ based magnetic material where its average particle size is 1 to 10 μm, its average aspect ratio $AR_{ave}$ is 0.8 or more, and mechanical milling is not applied after an Sm—Fe alloy is nitrided, the spherical $Sm_2Fe_{17}N_3$ based magnetic material being covered with epoxy oligomer that is solid at a room temperature; (2) a linear polymer that has an active hydrogen group in which to react to the oligomer; and (3) an additive to be added in when necessary;

<2> a discontinuous phase includes an $Nd_2Fe_{14}B$ based magnetic material where its average particle size is 50 to 150 μm, and its average aspect ratio $AR_{ave}$ is 0.65 or more, the $Nd_2Fe_{14}B$ based magnetic material being covered with epoxy oligomer that is solid at a room temperature:

<3> the air-gap ratio of a granular compound on the continuous and discontinuous phases is 5% or less;

<4> the particle size of the compound is 1 mm or less; and

<5> a composition where the crosslinking agent of an impalpable powder is physically adhered on the surface of the granular compound is formed into a predetermined shape through a magnetic field press at 50 MPa or less.

The following methods can be considered as a specific means that the air-gap ratio for the granular compound on the continuous and discontinuous phases can be 5% or less. That is, the mixtures of the continuous and discontinuous phases are mixed by means of a mixing roll at least in a molten linear polymer. The mixed materials that have been cooled down to a room temperature are then shredded so as to obtain granular compound with a particle size of at least 1 mm or less. Aim to make the mixed materials to have the particle size of 1 mm or less is to provide powder flowability. Here, if the particle size is 1 mm or less, there is no obstruction of making magnetic materials to be arranged in the magnetic fields in a melting condition of the linear polymer. Note that if the particle size becomes greater than 1 mm (exclusive), a crosslinking reaction between the granular compound and crosslinking agents of impalpable powder that have been physically adhered on the surface of the granular compound will become heterogeneity. Accordingly, that causes mechanical deficiencies of the resin bonded magnet along with strength deterioration.

By performing the above described mixing in a molten linear polymer, it is possible to set the air-gap ratio of the granular compound to be 5% or less. Here, it should be emphasized that it is possible to obtain the anisotropic rare earth-iron based resin bonded magnet according to the present invention with the air-gap ratio of 5% or less at an extremely low temperature of 50 MPa or less.

As a crosslinking agent according to the present invention, a so-called latent crosslinking agent can be suitably exemplified, the latent crosslinking agent being, for example, an imidazole adduct (2-phenyl-4,5-dihydroxymethylimidazole) with a thermal decomposition temperature of 230° C. where its average particle size is approximately 5 μm.

Next, in the present invention, in order to obtain the magnetic stability of the anisotropic rare earth-iron based resin bonded magnet, the following conditions should be established. That is, when the coercivity of $Sm_2Fe_{17}N_3$ based magnetic material at a room temperature is $HcJp_S$, the coercivity of $Nd_2Fe_{14}B$ based magnetic material is $HcJp_N$, and a ratio between $HcJp_S$ and $HcJp_N$ ($HcJp_S/HcJp_N$) is α, $HcJp_N$ will be 1 to 1.25 MA/m. Further details are explained hereinbelow.

A relation between the coercivity of $Nd_2Fe_{14}B$ based magnetic material (for example, an alloy composition $Nd_{12.3\text{-}7.6}Dy_{0.3\text{-}50}Fe_{64.6}CO_{12.3}B_{6.0}Ga_{0.6}Zr_{0.1}$) at a room temperature and its $(BH)_{maxPN}$ can be defined to have a certain tendency as shown in FIG. 1. As clearly shown in the FIG., it is possible to enhance $HcJp_N$ by improving an anisotropic magnetic field Ha by Dy. However, in this case, if value exceeds 1.25 MA/m, the decrease of $(BH)_{maxPN}$ will be accelerated. In this regard, it is true that the crystal grain $HcJp_N$ will increase while a part of the crystal grain Ha is increased according to Dy substitution. On the other hand, as to a large number of $Nd_2Fe_{14}B$ crystal grain where Ha is not alternated, flux reversal will occur starting from a low reverse magnetic field. Accordingly, the squareness of a demagnetization curve ($Hkp_N/HcJp_N$ where $Hkp_N$ is a reverse magnetic field where remanence $Mrp_N$ is 90%) will be decreased along with the addition of Dy. Here, $(BH)_{maxPN}$ which is 1.25 MA/m or less will be constant in most cases. To the contrary, if $HcJp_N$ becomes smaller, magnetic stability such as irreversible demagnetization will be generally lowered. Accordingly, $HcJp_N$ according to the present invention can be defined as that a high level of $HcJp_N$ is obtainable, but the level should be within a range where the $(BH)_{maxPN}$ is not subjected to large decrease, that is, 1 to 1.25 MA/m, Further, in the anisotropic rare earth-iron based resin bonded magnet according to the present invention, for improving irreversible demagnetization, demagnetization proof stress against reverse magnetic fields at a high temperature, or magnetic performance typically defined by a $(BH)_{max}$, when the coercivity of $Sm_2Fe_{17}N_3$ based magnetic material is $HcJp_S$, the coercivity of $Nd_2Fe_{14}B$ based magnetic material at a room temperature is $HcJp_N$, and a ratio between $HcJp_S$ and $HcJp_N$ ($HcJp_S/HcJp_N$) is α, the following can be determined: $HcJp_N$ is 1 to 1.25 MA/m while $HcJp_S$ is equal to or less than $HcJp_N$ ($HcJp_S \leqq HcJp_N$). Further, α should be 0.75 or less, or more preferably 0.65 or less.

In the anisotropic rare earth-iron based resin bonded magnet according to the present invention, when its remanence is $Mr_M$, the remanence of a mixture between a spherical $Sm_2Fe_{17}N_3$ based magnetic material (real density: 7.67 $Mg/m^3$) and an $Nd_2Fe_{14}B$ based magnetic material (real density: 7.55 $Mg/m^3$) is $Mr_p$, and the volume fraction of the whole magnetic material accounting for the resin bonded magnet is $Vf_p$, the following can be established. That is, by setting that $Vf_p$ is equal to or greater than 80 vol. % ($Vf_p \geqq 80$ vol. %) and $\alpha$ is 0.75 or less, the orientation degree of the magnetic material $Mr_M/(Mr_p \times Vf_p)$ can be 0.96 or more while its $(BH)_{max}$ is 170 kJ/m$^3$ or more. Further, by setting that $Vf_p$ is equal to or greater than 80 vol. % ($Vf_p \geqq 80$ vol. %) and $\alpha$ is 0.65 or less, the orientation of the magnetic material $Mr_M/(Mr_p \times Vf_p)$ can be 0.98 or more while its $(BH)_{max}$ is 180 kJ/m$^3$ or more.

Further, in the anisotropic rare earth-iron based resin bonded magnet according to the present invention, in case that the squareness of a demagnetization curve at a room temperature is $Hk/HcJ_{RT}$, and the squareness at 100° C. is $Hk/HcJ_{100}$, it would be preferable that $Hk/HcJ_{RT} < Hk/HcJ_{100}$.

Here, considering a rotary machine that can effectively secure the magnetic stability and can employ the air-gap magnetic flux density of the anisotropic rare earth-iron based resin bonded magnet according to the present invention (that is, a magnetic circuit structure between an iron core and the magnet according to the present invention), it would be preferable that air-gap permeance coefficient Pc is 3 or more.

As discussed hereinabove, in the anisotropic rare earth-iron based resin bonded magnet according to the present invention, it is possible to obtain the following structure that coercivity HcJ at a room temperature is approximately 1 MA/m or more while the squareness of the demagnetization at a high temperature which satisfies $Hk/HcJ_{RT} < HcJ_{100}$ will not be deteriorated. Further, since a high magnetic property where the maximum energy product $(BH)_{max}$ is 170 or 180 kJ/m$^3$ or more is also provided, it can be regarded as the next generation type of the isotropic $Nd_2Fe_{14}B$ based resin bonded magnet with $(BH)_{max}$ of 80 kJ/m$^3$ contributing to the miniaturization and the high mechanical output of the rotary machine.

[Embodiments]

Hereinafter, the present invention will be explained in further details based on embodiments. The present invention is not however limited to the embodiments.

Figure 2:
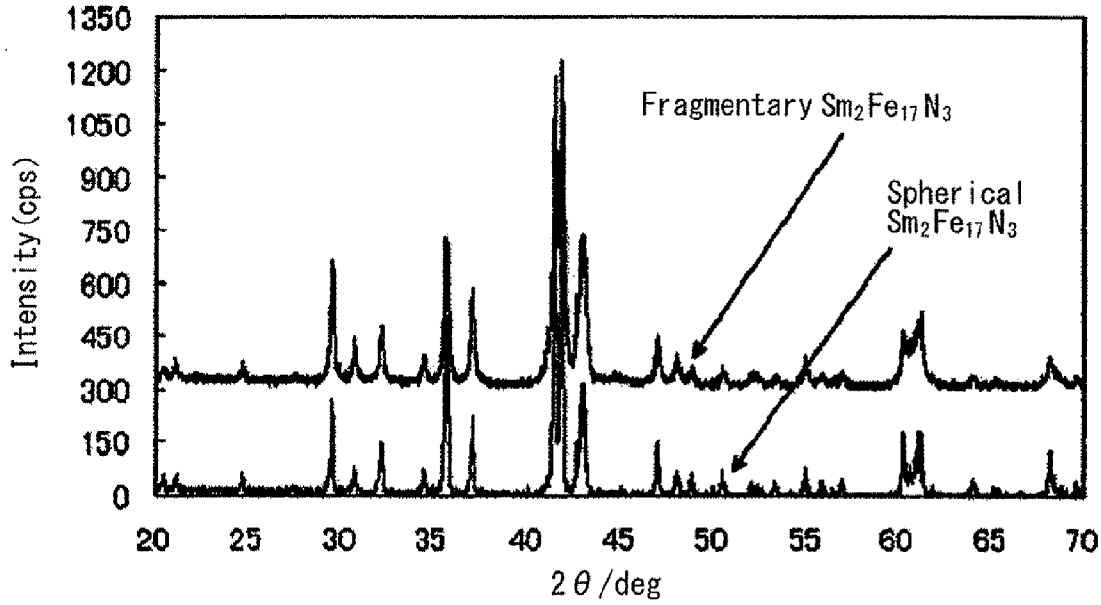
FIG. 2 is a chart indicating the X-ray diffraction pattern of an $Sm_2Fe_{17}N_3$ based magnetic materials.

FIG. 2 is a chart indicating X-ray diffraction patterns of $Sm_2Fe_{17}N_3$ based magnetic materials produced without conducting mechanical milling following nitriding of an Sm—Fe alloy, and a fragmentary $Sm_2Fe_{17}N_3$ based magnetic material that has been milled through a jet mill following nitriding. As shown, there is no difference in both crystal structures based on a $Sm_2Fe_{17}N_3$ intermetallic compound.

Figure 3A:
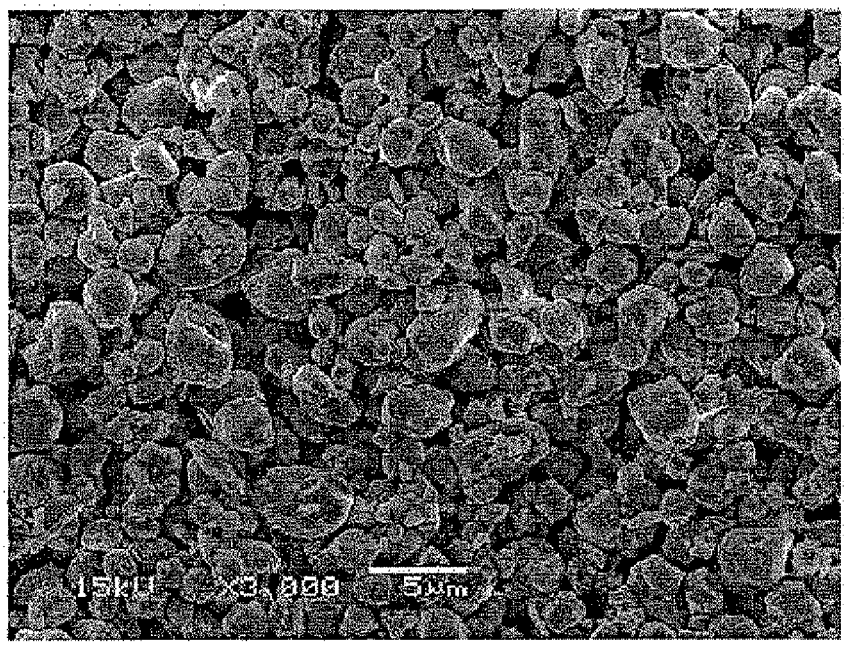
FIGS. 3A and 3B are expanded views indicating two kinds of $Sm_2Fe_{17}N_3$ based magnetic materials.
Figure 3B:
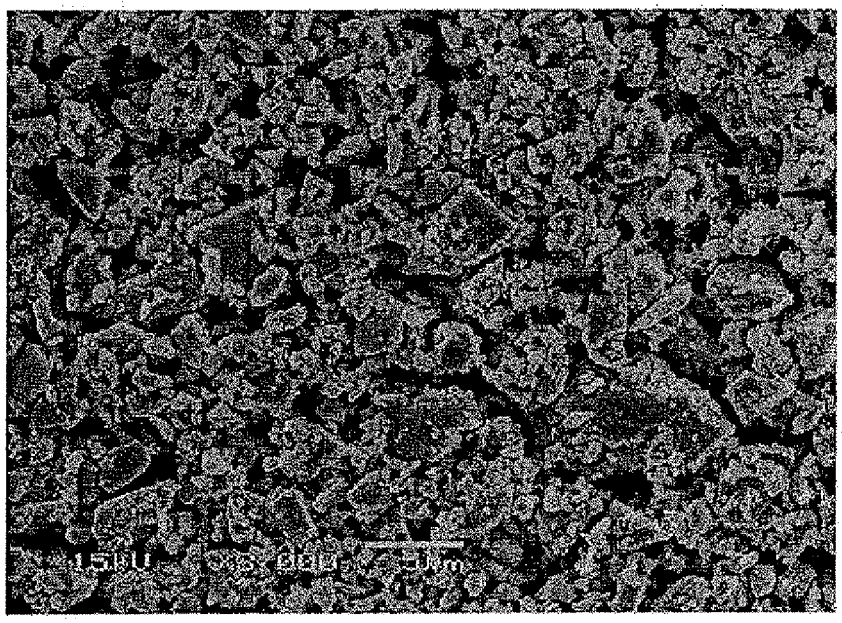

FIGS. 3A and 3B are SEM (Scanning Electron Microscope) photos indicating two kinds of magnetic materials. Considering the fragmentary $Sm_2Fe_{17}N_3$ based magnetic materials as shown in FIG. 3B, it is possible to observe the aggregation of micronized powder formed by milling, the micronized powder having a particle size of less than 1 μm (exclusive). On the other hand, as shown in FIG. 3A, the $Sm_2Fe_{17}N_3$ based magnetic material produced without mechanical milling after nitriding an Sm—Fe alloy does not contain the micronized powder having a particle size of less than 1 μm (exclusive).

As disclosed by Japanese Patent Application Laid-Open No. 2000-12316, the micronized powder discussed hereinabove will negatively influence magnetic properties such as coercivity $HcJ_S$ of $Sm_2Fe_{17}N_3$ based magnetic materials. However, by being subjected to a temperature history of 50° C. or more that is inevitable when resin bonded magnets are formed into a specific shape, the micronized powder having a particle size of less than 1 μm (exclusive) will be disappeared. Accordingly, as to the final magnetic property of the resin bonded magnets, $Sm_2Fe_{17}N_3$ based magnetic materials having a particle size of 1 μm or more where their magnetic properties have not been impaired are going to take over. More specifically, the micronized powder having a particle size of less than 1 μm (exclusive) that can be observed at the fragmentary $Sm_2Fe_{17}N_3$ based magnetic materials as shown in FIG. 3B does not contribute to the magnetic property of the resin bonded magnet. Moreover, it will increase viscidity when dispersed in melted molecule chain of polymer and oligomer. Further, it may be possible that the aggregation force of the micronized powders interferes the orientation of the magnetic materials due to magnetic fields, whereby it would be preferable to remove the micronized powder of less than 1 μm (exclusive) from the anisotropic rare earth-iron based resin bonded magnet according to the present invention.

Figure 4:
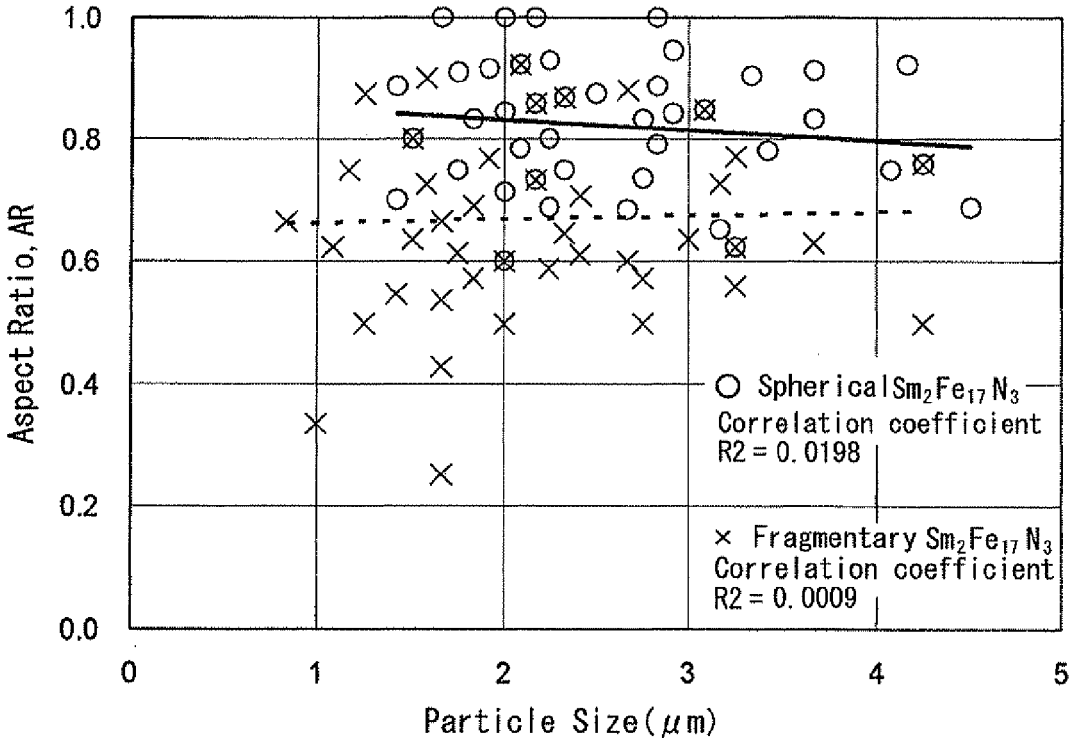
FIG. 4 is a chart indicating a relation between the particle size and the aspect ratio AR of the $Sm_2Fe_{17}N_3$ based magnetic materials.

FIG. 4 is a chart indicating a relation between the particle size of $Sm_2Fe_{17}N_3$ based magnetic materials and an aspect ratio AR ("b/a" should be established when the maximum diameter of a particle image (a scanning electron microscopy imaging) is "a" while the maximum diameter perpendicular to the "a" is "b"). FIG. 4 is correspondent to FIGS. 3A and 3B. The $AR_{ave}$ of the $Sm_2Fe_{17}N_3$ based magnetic materials corresponding to FIG. 3A is 0.80 (Dispersion σ:0.01) when n=50 (the minimum value is 0.6). On the other hand, the $AR_{ave}$ of the $Sm_2Fe_{i7}N_3$ based magnetic materials corresponding to FIG. 3B is 0.67 (Dispersion σ: 0.02) when n=50 (the minimum value is 0.24).

As discussed hereinabove, the $Sm_2Fe_{17}N_3$ based magnetic material that is applied to the anisotropic rare earth-iron based resin bonded magnet according to the present invention should be satisfied with the following condition: 1) the magnetic material should be a sphere produced without mechanical milling after the Sm—Fe alloy of FIG. 3A is nitrided; and 2) the micronized powder having a particle size of less than 1 μm (exclusive) that is inevitably produced with mechanical milling is excluded.

Here, as shown in FIG. 4, the correlation coefficient R of the aspect ratio AR relative to particle sizes of the spherical $Sm_2Fe_{17}N_3$ based magnetic material produced without mechanical milling after the Sm—Fe alloy is nitrided, and the fragmentary $Sm_2Fe_{17}N_3$ based magnetic material is both less than 0.01 (exclusive). Accordingly, the aspect ratio AR does not depend on the particle size but depends on their manufacturing processes of the magnetic materials themselves.

Figure 5A:
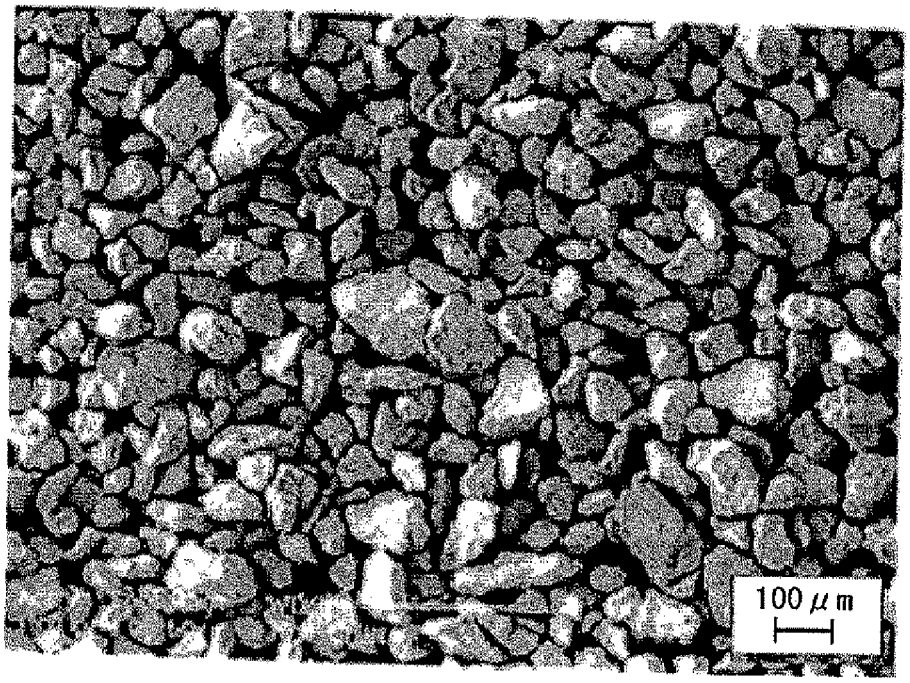
FIGS. 5A and 5B are expanded views indicating two kinds of the $Nd_2Fe_{14}B$ based magnetic materials.
Figure 5B:
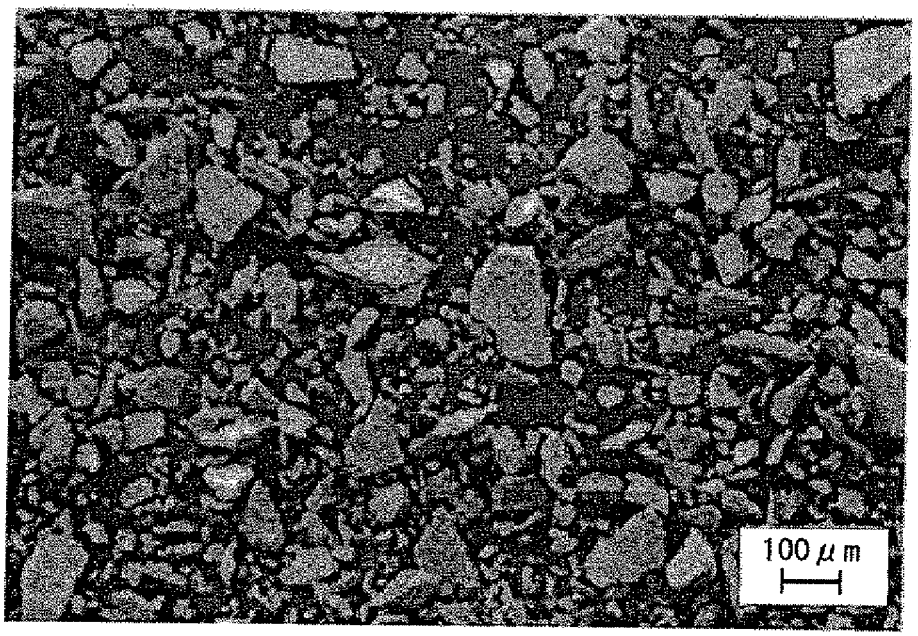

FIGS. 5A and 5B are SEM photos. FIG. 5A indicates a so-called HDDR-$Nd_2Fe_{14}B$ based magnetic material in which hydrogen decomposition/recombination is conducted. FIG. 5B is an $Nd_2Fe_{14}B$ based magnetic material that has been ground after hot working bulks are roughly milled with a jaw crusher. FIG. 5B shows $Nd_2Fe_{14}B$ crystal where uniaxial compression is applied at a temperature of over the crystallization temperature of $Nd_2Fe_{14}B$, and observation is conducted in a direction perpendicular to a compression axial direction of bulks that are provided with anisotropic features through hot working. The $Nd_2Fe_{14}B$ crystal is formed into flat as shown. Further, the materials that are mechanically milled also tend to be flat. The thickness direction of the materials and a C-axial direction are generally correspondent to each other. That is, the magnetic materials having a shape magnetic anisotropy perpendicular to the C-axial direction can be produced.

Considering the above magnetic material, it would be difficult to adjust to be that its average particle size is set to 50 to 150 μm while its average aspect ratio $AR_{ave}$ is set to 0.65 or more. On the other hand, the crystal of a so-called HDDR-$Nd_2Fe_{14}B$ based magnetic material where hydrogen decomposition/recombination is performed as shown in FIG. 5A is not flat. This is due to a reason that since $Nd_2Fe_{14}B$ crystal grain boundary is subjected to hydrogen embrittlement at the final stage of the hydrogen decomposition/recombination treatment (DR treatment) that is conducted to hot working bulks, there will be nearly no necessity for mechanical milling treatments. Therefore, it would be possible to easily obtain magnetic materials where their average particle sizes are 50 to 150 μm, and their average aspect ratios $AR_{ave}$ are 0.65 or more.

Next, through application of the $Sm_2Fe_{17}N_3$ based magnetic materials and the $Nd_2Fe_{14}B$ based magnetic materials according to the present invention,

[1] a continuous phase is formed by comprising: (1) an $Sm_2Fe_{17}N_3$ based magnetic material that is coated with 4.5 vol. % of an o-cresol novolac epoxy oligomer where an epoxy equivalent is 205 to 220 g/eq, and a melting point is 70 to 76° C.; (2) 9.1 vol. % of a linear polymer that has an average molecular weight Mn of 4000 to 12000 and has a molecular chain amino active hydrogen making a crosslinking reaction with the oxazolidone ring of the oligomer; (3) 1.8 vol. % of a partial esterification material including pentaerythritol and higher fatty acid as internal lubricant,

[2] a discontinuous phase is coated with 2.0 vol. % of o-cresol novolac epoxy oligomer where an epoxy equivalent is 205 to 220 g/eq, and a melting point is 70 to 76° C., and

[3] the continuous phase is melted and mixed by means of an 8-inch mixing roll mill (a rotational speed: 12 rpm and a temperature: 140° C.). Further, the discontinuous phase will be added thereinto so as to produce melted/mixed materials comprising the continuous and discontinuous phases.

Figure 6A:
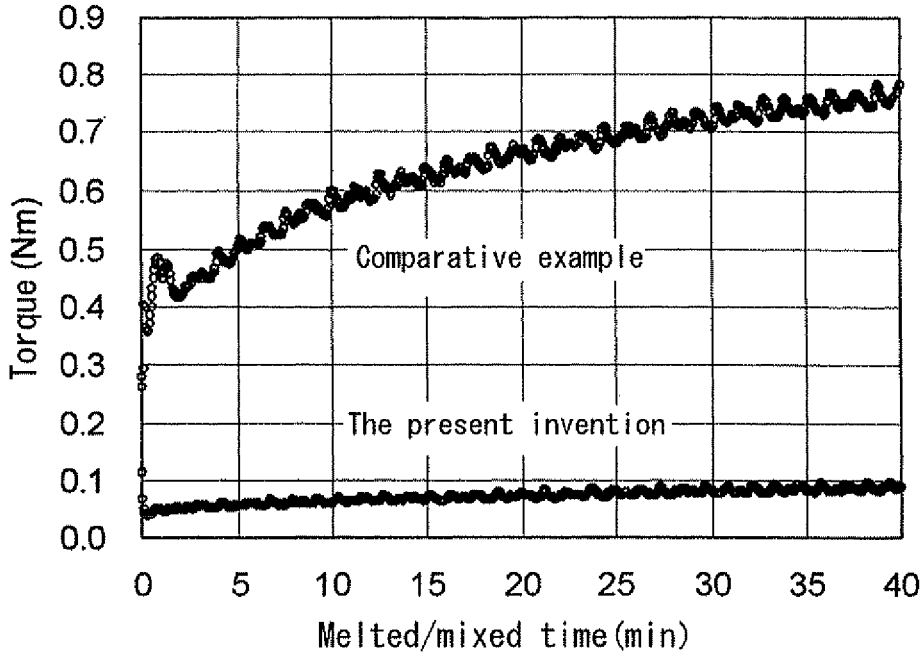
FIGS. 6A and 6B are charts indicating the torsion torque behavior of melt-blending materials.
Figure 6B:
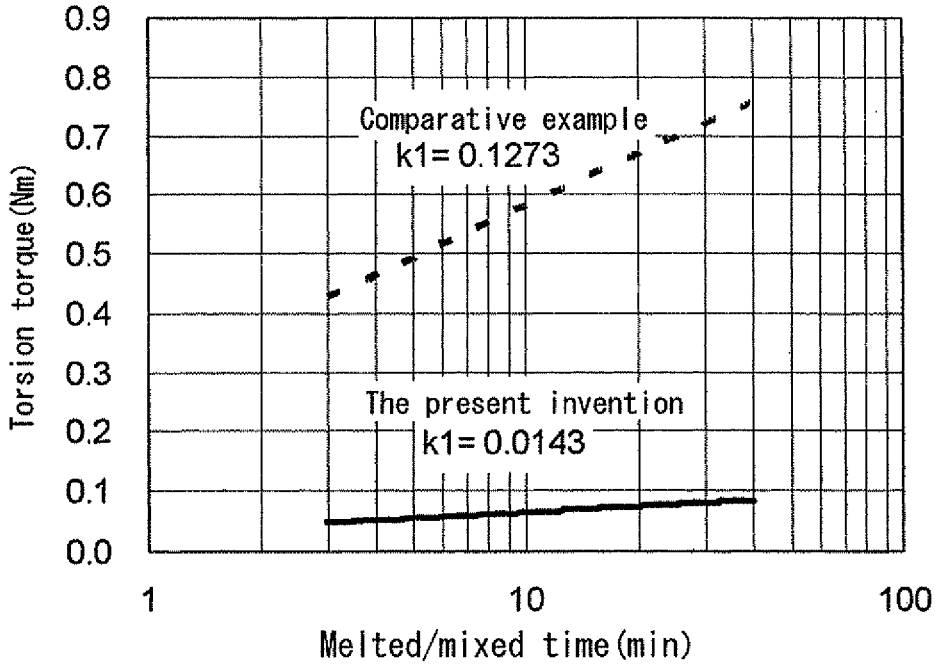

FIG. 6A indicates a torsion torque behavior where 17.5 g of the above mentioned melted/mixed materials are directly measured with a curelastmeter in a condition that a pressure is 98 kN and an oscillating angle is ±0.5 degree. Further, FIG. 6B determines an inclination that is correspondent to the first reaction rate constant K supposing that the rise of torque in FIG. 6A is the ring opening reaction (the first reaction) of the oxazolidone ring due to the amino active hydrogen (—NHCO—) of the linear polymer. As obvious, compared to the melted/mixed materials including the spherical $Sm_2Fe_{17}N_3$ based magnetic material of FIG. 3A according to the present invention, the melted/mixed materials including the fragmentary $Sm_2Fe_{17}N_3$ based magnetic material as shown in FIG. 3B has a reaction speed that is one digit larger than the spherical $Sm_2Fe_{17}N_3$ based magnetic material. This is why, even though they have an identical particle size, the fragmentary $Sm_2Fe_{17}N_3$ based magnetic material has an average aspect ratio $AR_{ave}$ smaller than the one of the spherical $Sm_2Fe_{17}N_3$ based magnetic material. Further, the fragmentary $Sm_2Fe_{17}N_3$ based magnetic material contains micronized powder. This is due to the large specific surface area of the magnetic materials. Here, the reaction velocity fixed number of this system is based on a reaction between epoxy oligomer that coats $Sm_2Fe_{17}N_3$ based magnetic material and the amino active hydrogen of a linear polymer. Accordingly, the concentration of a reaction substrate depends on the specific surface area of the $Sm_2Fe_{17}N_3$ based magnetic materials.

As discussed hereinabove, considering chemical stabilities of the melted/mixed treatments, it would be preferable that the spherical $Sm_2Fe_{17}N_3$ based magnetic materials according to the present invention as shown in FIG. 3A are included. Here, based an Archimedian method, the density of the melted/mixed materials is 6.1 $Mg/m^3$ while its air-gap ratio is less than 5% (exclusive).

Next, the melted/mixed materials are cooled off up to a room temperature, and then shredded and classified with a general method so as to obtain a granular compound having a particle size of 1 mm or less. Further, as the crosslinking agent of the micronized powder, 1.8 vol. % of imidazole adduct (2-phenyl-4,5-dihydroxymethylimidazole) with an average particle size of 4 μm and thermal decomposition temperature of 230° C. is adhered on the surface of the granular compound through a dry-mixing process with a V-blender. With these processes, a composition according to the present invention can be obtained. Here, the volume fraction of the whole magnetic materials accounting for the composition will be 80.7 vol. %. Further, when removing internal lubricant that is eluted from the continuous phase to the system during magnetic field formation, the volume fraction of the whole magnetic materials accounting for the resin bonded magnet will be 82.7 vol. %. Note that this value will be a level in which to exceed the volume fraction 80 vol. % of the magnetic material of an isotropic $Nd_2Fe_{14}B$ based resin bonded magnet with a density of 6 $Mg/m^3$.

Figure 7A:
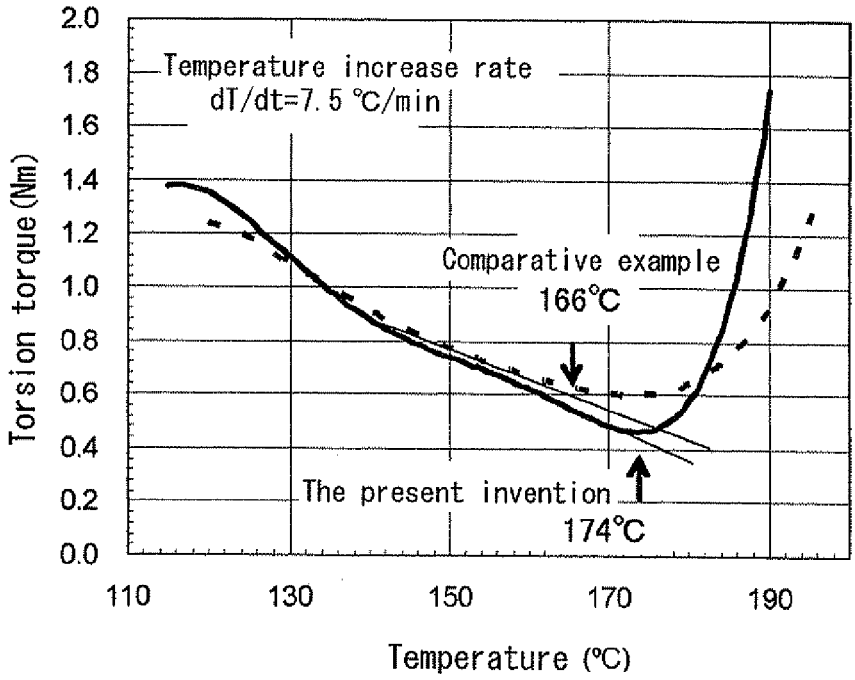
FIGS. 7A and 7B are charts indicating the torsion torque behavior of a composition including a crosslinking agent.

Through the application of a curelastmeter, FIG. 7A indicates torsion torque behaviors based on a temperature where the above composition according to the present invention is subjected to constant temperature rise from 110° C. to 195° C. (dT/dt=7.5° C./min) when a pressure is 98 kN, and an oscillating angle is ±0.5 degree. According to FIG. 7A, the temperature which the torsion torque increases due to crosslinking reaction of the composition is: 1) 174° C. in case of a composition including the spherical $Sm_2Fe_{17}N_3$ based magnetic material according to the present invention as shown in FIG. 3A; and 2) 166° C. in case of a composition including the fragmentary $Sm_2Fe_{17}N_3$ based magnetic material as shown in FIG. 3B. Based on the above, considering the gelation of the compositions, it is possible to observe the accelerated effects of the crosslinking reaction due to micronized powder with a particle size of less than 1 μm (exclusive). In addition, considering a temperature where the composition is formed through a magnetic field press, it would be preferable to be more than 160° C. or more but less than a temperature where the torsion torque increases due to the crosslinking reaction.

Figure 7B:
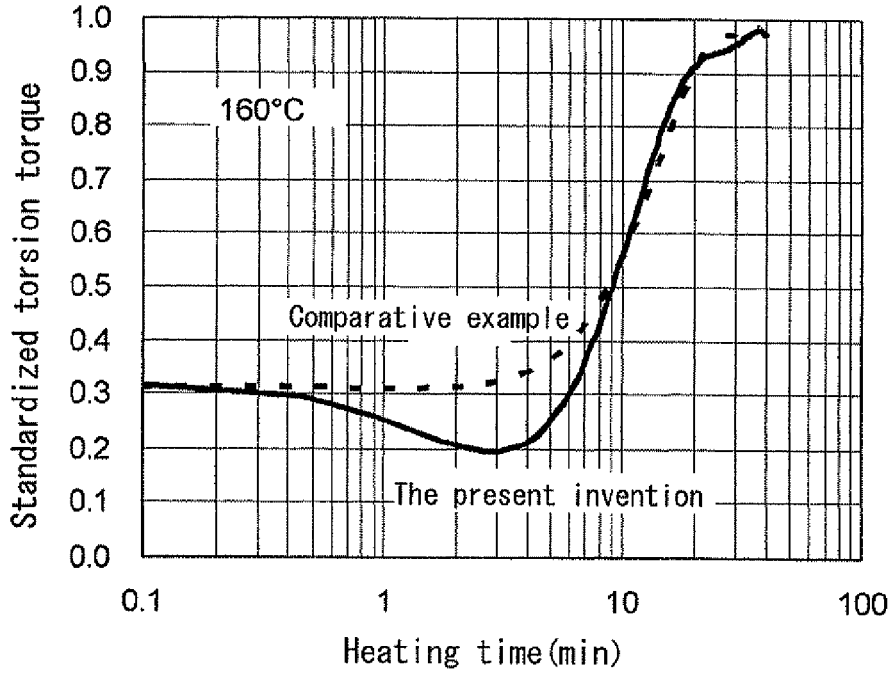

FIG. 7B indicates torsion torque variations based on the crosslinking reaction when composition is formed through the magnetic field press at a temperature of 160° C. As shown in the FIG., in case that the compositions include the spherical $Sm_2Fe_{17}N_3$ based magnetic material according to the present invention as shown in FIG. 3A, plasticization will be advanced right before gelation due to an external force (torsion). Accordingly, the torsion torque will be once decreased. However, considering the compositions including the fragmentary $Sm_2Fe_{17}N_3$ based magnetic materials as shown in FIG. 3B, the decrease of torque, that is, the plasticization of the system can not be observed. This suggests that micronized powder with a particle size of less than 1 μm will influence on magnetic orientation.

Next, the compositions according to the present invention are formed into 7×7 mm cube through the magnetic field press in a condition that a temperature is 160° C., an orthogonal magnetic field is 1.4 MA/m or more, and a pressure is less than 50 MPa (inclusive). Accordingly, anisotropic rare earth-iron based resin bonded magnets according to the present invention and comparative examples are obtained. Here, the composition according to the present invention is precedently adjusted to have the density of 6 $Mg/m^3$ or more in a melted/mixed condition. By rearranging magnetic materials by means of external magnetic fields in a condition that a linear polymer is melted in a molding cavity, it would be possible to re-obtain the density of 6 $Mg/m^3$ or more even with a lower pressure of 50 MPa.

Figure 8A:
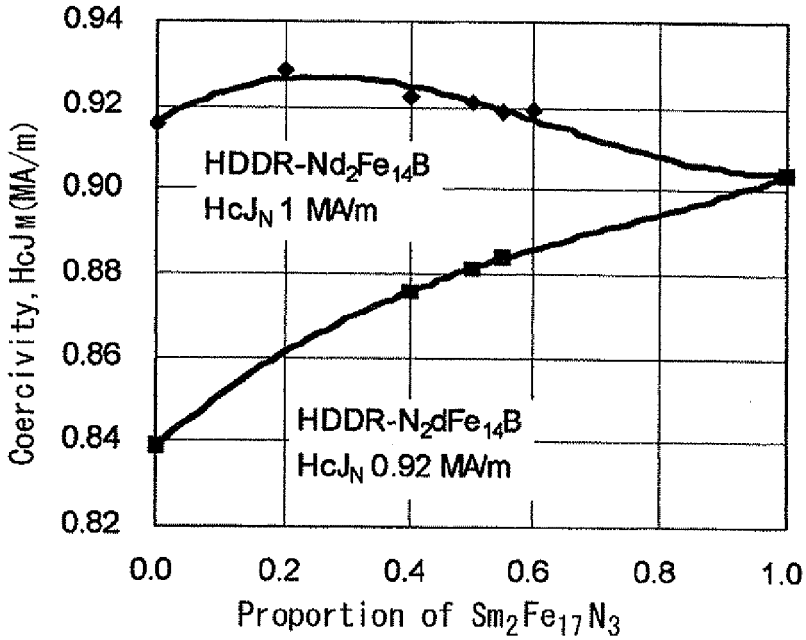
FIGS. 8A and 8B are charts indicating a relation between the coercivity of spherical $Sm_2Fe_{17}N_3$ based magnetic materials and the squareness Hk/HcJ of a magnet.

FIG. 8A is a chart indicating coercivity $HcJ_M$ of the resin bonded magnets when changing the proportion of the coercivity $HcJp_S$ of the spherical $Sm_2Fe_{17}N_3$ based magnetic materials (0.92 MA/m). Here, the coercivity $HcJp_N$ of $Nd_2Fe_{14}B$ based magnetic materials at a room temperature is set to 1 MA/m and 0.92 MA/m. As clearly shown in the FIG., when the $HcJp_N$ reaches the lower bound of the present invention or 1 MA/m while $HcJp_S$ is equal to or less than $HcJp_N$ ($HcJp_S \leqq HcJp_N$), a notable decrease of the $HcJ_M$ can not be observed. However, when $HcJp_N$ is equal to $HcJp_S$ ($HcJp_N = HcJp_S$), the $HcJ_M$ will be decreased in proportion to the ratio of the spherical $Sm_2Fe_{17}N_3$ based magnetic material. This means that magnetic stabilities represented by irreversible demagnetization are decreased.

Figure 8B:
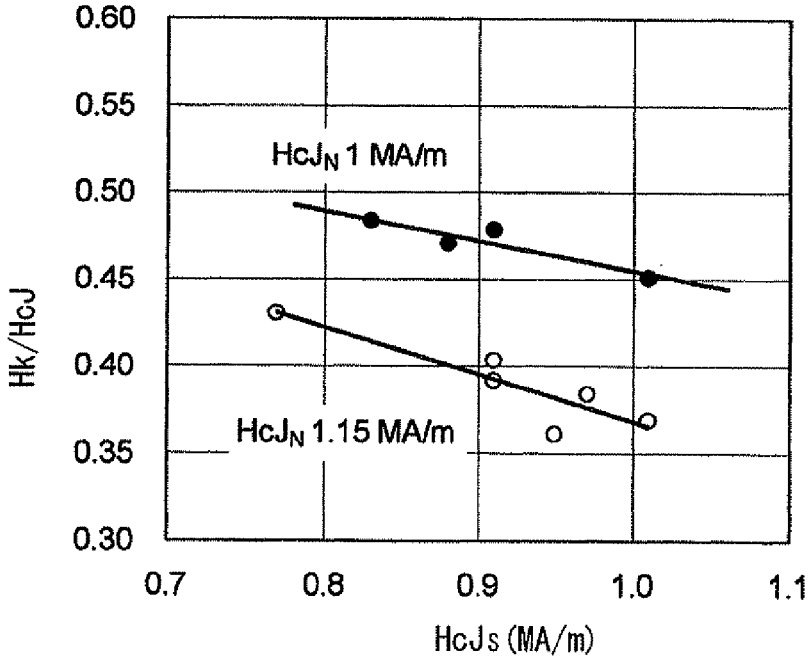

Next, FIG. 8B is a chart indicating the relation of squareness Hk/HcJ of a demagnetization curve at a room temperature in case that $HcJp_N$ is 1 and 1.15 MA/m where the coercivity $HcJp_N$ of the $Nd_2Fe_{14}B$ based magnetic material is $HcJp_N$, and the coercivity of the spherical $Sm_2Fe_{17}N_3$ based magnetic material is $HcJp_S$. However, this magnetic property has been measured through a B—H tracer (Measuring magnetic fields Hm: ±2.4 MA/m) subjected to 7 mm cubed sample. When considering an $Nd_2Fe_{14}B$ based magnetic material where its total weight satisfies $HcJp_N$=1.15 MA/m ($HcJp_N$ is equal to 1.15 MA/m), Hk/HcJ is defined by 0.31. Accordingly, in the anisotropic rare earth-iron based resin bonded magnet according to the present invention where $HcJp_N$ is equal to or greater than $HcJp_S$ ($HcJp_N \geqq HcJp_S$), it is possible to improve Hk/HcJ of the $Nd_2Fe_{14}B$ based resin bonded magnet.

Figure 9A:
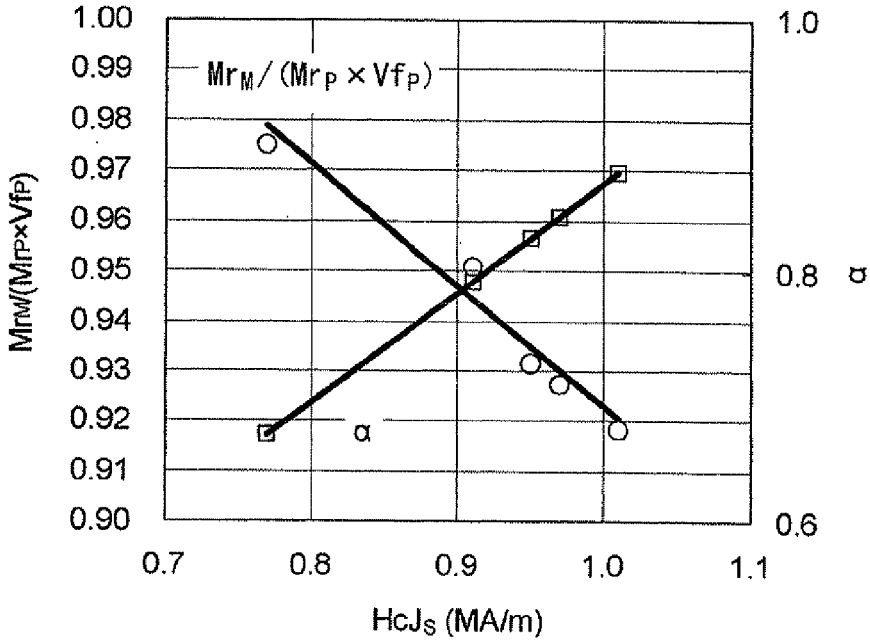
FIGS. 9A and 9B are charts indicating relations of: $HcJp_S$ and $Mr_M/(Mr_p \times Vf_p)$; a; and $Mr_M/(Mr_p < Vf_p)$ and the $(BH)_{max}$ of a magnet.

FIG. 9A indicates a relation between the orientation degree of magnetic materials $Mr_M/(Mr_p \times Vf_p)$ relative to $HcJp_S$ when $Vf_p$ is equal to or greater than 80.7 vol.% ($Vf_p \geqq 80.7$ vol. %) and α. On the other hand, FIG. 9B indicates a relation between the orientation degree of magnetic materials $Mr_M/(Mr_p \times Vf_p)$ and a $(BH)_{max}$ of a resin bonded magnet. Here, those FIGS. satisfy the following condition: the coercivity of $Nd_2Fe_{14}B$ based magnetic materials at a room temperature is $HcJp_N$; the coercivity of spherical $Sm_2Fe_{17}N_3$ based magnetic materials is $HcJp_S$; a ratio between $HcJp_S$ and $HcJp_N$ ($HcJp_S/HcJp_N$) is a; the remanence of a resin bonded magnet is $Mr_M$; the remanence of a compound based on the spherical $Sm_2Fe_{17}N_3$ and the $Nd_2Fe_{14}B$ based magnetic materials is $Mr_p$; the volume fraction of the whole magnetic materials accounting for the resin bonded magnet is $Vf_p$; and the orientation degree of the whole magnetic materials in the resin bonded magnet is $Mr_M/(Mr_p \times Vf_p)$.

Figure 9B:
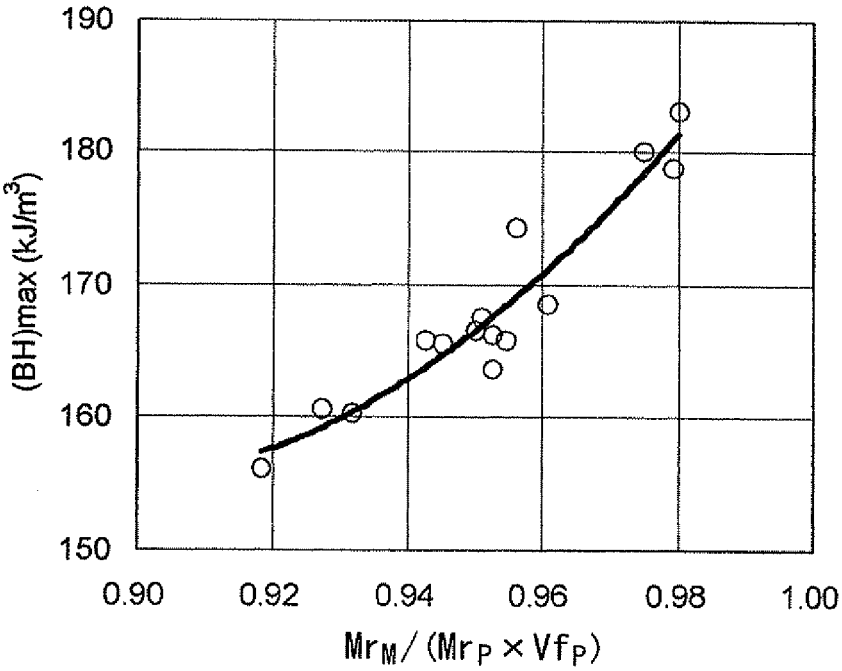

Based on FIG. 9A and FIG. 9B, when α is approximately set to 0.75, $Mr_M/(Mr_p \times Vf_p)$ becomes 0.96 whereby the $(BH)_{max}$ of the anisotropic rare earth-iron based resin bonded magnet according to the present invention exceeds 170 $kJ/m^3$. Further, when α is approximately set to 0.65, $Mr_M/(Mr_p \times Vf_p)$ becomes approximately 0.98 whereby the $(BH)_{max}$ according to the present invention reaches to 180 $kJ/m^3$.

As discussed hereinabove, in the present invention, when the coercivity of the $Nd_2Fe_{14}B$ based magnetic material at a room temperature is $HcJp_N$, and the coercivity of the spherical $Sm_2Fe_{17}N_3$ based magnetic material is $HcJp_S$, it would be necessary to satisfy that $HcJp_N$ is equal to or greater than $HcJp_S$. In addition, more preferably, when a ratio between $HcJp_S$ and $HcJp_N$ ($HcJp_S/HcJp_N$) is α, α is set to 0.75 or 0.65. Accordingly, when the remanence of the resin bonded magnet is $Mr_M$, the remanence of a compound including the spherical $Sm_2Fe_{17}N_3$ based magnetic material and the $Nd_2Fe_{14}B$ based magnetic material is $Mr_p$, and the volume fraction of the whole magnetic material accounting for the resin bonded magnet is $Vf_p$, $Vf_p$ is equal to or greater than 80 vol. %, and when α is 0.75 or 0.65, the orientation degree of the whole magnetic material $Mr_M/(Mr_p \times Vf_p)$ becomes 0.96 or 0.98, respectively. Accordingly, the present invention can provide the anisotropic rare earth-iron based resin bonded magnet where the magnetic material is highly oriented.

Figure 10:
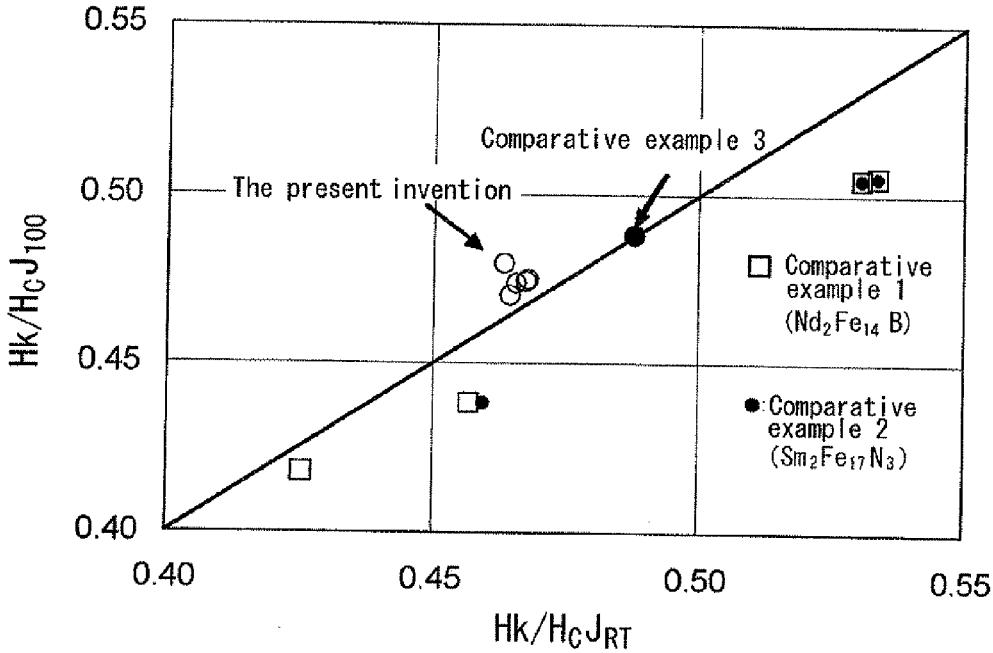
FIG. 10 is a chart indicating a relation between $Hk/HcJ_{RT}$ and $Hk/HcJ_{100}$.

In FIG. 10, the coercivity $HcJp_N$ of the $Nd_2Fe_{14}B$ based magnetic material at a room temperature and the coercivity $HcJp_S$ of the spherical $Sm_2Fe_{17}N_3$ based magnetic material are both set to 1 MA/m. Further, the squareness of a demagnetization curve of the anisotropic rare earth-iron based resin bonded magnet at a room temperature according to the present invention is set to $Hk/HcJ_{RT}$, and a squareness at a temperature of 100° C. is set to $Hk/HcJ_{100}$. Based on the above condition, a relation between the $Hk/HcJ_{RT}$ and $Hk/HcJ_{100}$ is shown in the FIG. 10. Here, a diagonal line in the FIG. indicates that $Hk/HcJ_{RT}$ and $Hk/KcJ_{100}$ are equal to each other. As clearly shown in FIG. 10, a comparative example 1 ($Nd_2Fe_{14}B$ based resin bonded magnet) and a comparative example 2 ($Sm_2Fe_{17}N_3$ based resin bonded magnet) both satisfy that $Hk/HcJ_{RT}$ is greater than $Hk/HcJ_{100}$($Hk/HcJ_{RT} > Hk/HcJ_{100}$). On the other hand, the anisotropic rare earth-iron based resin bonded magnet satisfies that $Hk/HcJ_{RT}$ is less than $Hk/HcJ_{100}$ ($Hk/HcJ_{RT} < Hk/HcJ_{100}$). Further, a comparative example 3 indicates the features of an anisotropic rare earth-iron based resin bonded magnet where fragmentary $Sm_2Fe_{17}N_3$ based magnetic materials including micronized powder as shown in FIG. 3B are applied. As shown in FIG. 10, $Hk/HcJ_{RT}$ and $Hk/HcJ_{100}$ are both defined by 0.487, or $Hk/HcJ_{RT}$ and $Hk/HcJ_{100}$ are nearly equal to each other ($Hk/HcJ_{RT} \approx Hk/HcJ_{100}$). Further, there is also a case that $Hk/HcJ_{100}$ is slightly lower than $Hk/HcJ_{RT}$.

Figure 11A:
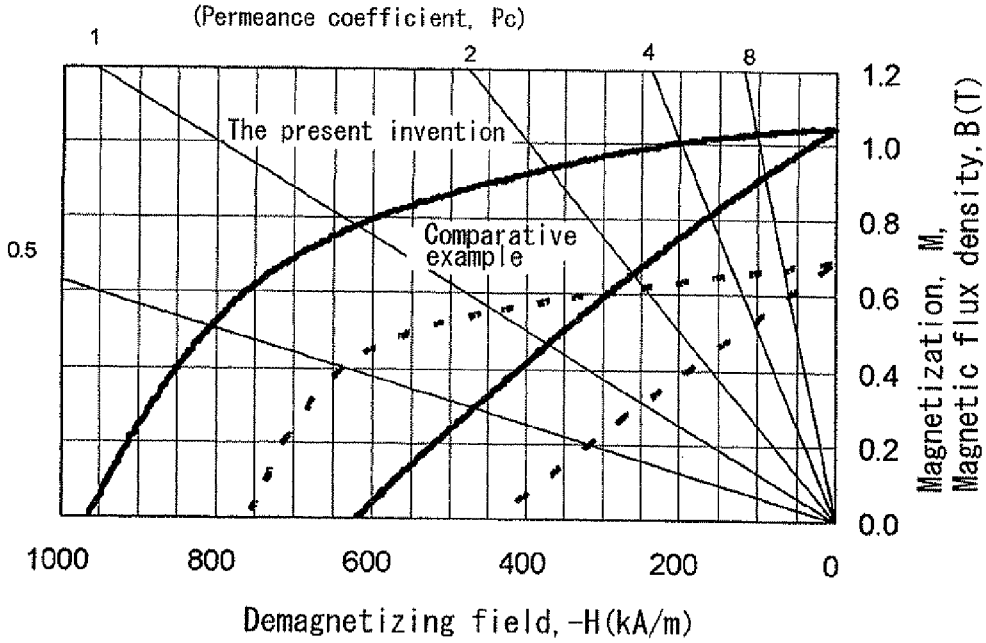
FIGS. 11A and 11B are charts indicating a demagnetization curve and the permeance dependence of the gain ratio of magnetic flux density.
Figure 11B:
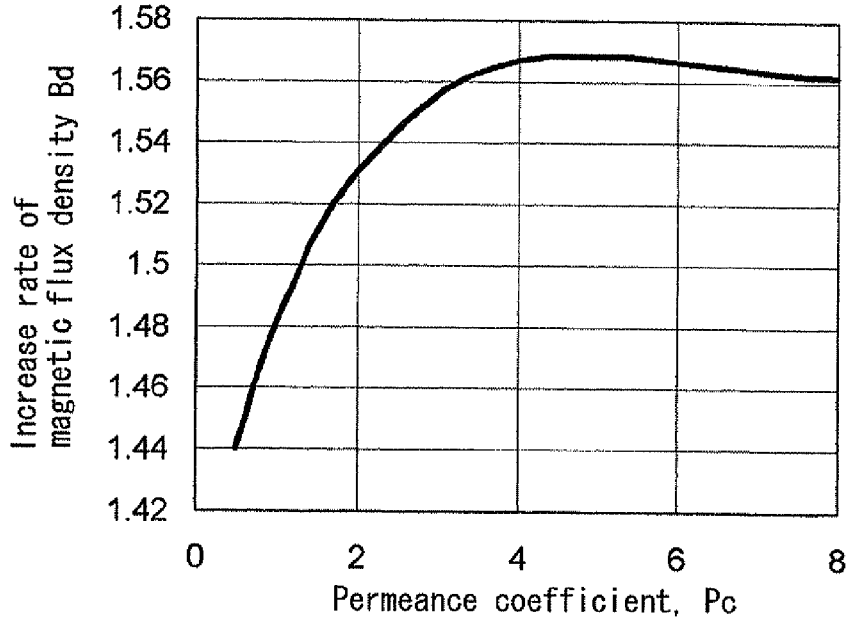

In FIG. 11A, the demagnetization curve of an anisotropic rare earth-iron based resin bonded magnet according to the present invention is comparatively shown with the demagnetization curve of an isotropic $Nd_2Fe_{14}B$ based resin bonded magnet (a comparative example). Here, in the anisotropic rare earth-iron based resin bonded magnet according to the present invention, its coercivity HcJ is 0.97 MA/m, its remanence Mr is 1.05 T, and its $(BH)_{max}$ is 179 $kJ/m^3$. On the other hand, in the isotropic $Nd_2Fe_{14}B$ based resin bonded magnet as the comparative example, its HcJ is 0.72 MA/m, Mr is 0.70 T, and its $(BH)_{max}$ is 79.7 $kJ/m^3$. Moreover, FIG. 11B indicates permeance dependency as to the increase rate of magnetic flux density in connection with the anisotropic rare earth-iron based resin bonded magnet according to the present invention and the isotropic $Nd_2Fe_{14}B$ based resin bonded magnet. As clearly shown in FIG. 11B, in order to establish rotary machines that can effectively secure the magnetic stability of the anisotropic rare earth-iron based resin bonded magnet according to the present invention, or to further improve the increase rate of an air-gap magnetic flux density for the rotary machines comprising an iron core and a magnetic circuit, it would be preferable that its permeance coefficient is Pc 3 or more.

As discussed hereinabove, in the anisotropic rare earth-iron based resin bonded magnet according to the present invention, it is possible that its coercivity HcJ at a room temperature is approximately 1 MA/m, and that the squareness of a high-temperature demagnetization curve ($Hk/HcJ_{RT} < Hk/HcJ_{100}$) is not deteriorated. Moreover, since high magnetic properties are obtainable (the maximum energy product $(BH)_{max}$ is 170, 180 $kJ/m^3$ or more), it can be the next generation type of isotropic $Nd_2Fe_{14}B$ based resin bonded magnets with $(BH)_{max}$ of 80 kJ/m$^3$ thereby contributing to miniaturization and a high mechanical output of the rotary machines.

What is claimed is:

1. An anisotropic rare earth-iron based resin bonded magnet comprising:

[1] a continuous phase including: (1) a spherical $Sm_2Fe_{17}N_3$ based magnetic material where an average particle size and an average aspect ratio $AR_{ave}$ of the magnetic material are 1 to 10 μm and 0.8 or more, respectively, in a condition that AR is b/a when the maximum diameter of a particle image is "a" while the maximum diameter perpendicular to the "a" is "b", and mechanical milling is not applied after an Sm—Fe alloy is nitrided, the spherical $Sm_2Fe_{17}N_3$ based magnetic material being covered with epoxy oligomer that is solid at a room temperature; and (2) a linear polymer that has an active hydrogen group in which to react to the oligomer; and

[2] a discontinuous phase being defined by an $Nd_2Fe_{14}B$ based magnetic material where an average particle size and an average aspect ratio $AR_{ave}$ of the magnetic material are 50 to 150 μm and 0.65 or more, respectively, the $Nd_2Fe_{14}B$ based magnetic material being covered with epoxy oligomer that is solid at a room temperature, the anisotropic rare earth-iron based resin bonded magnet further satisfying the following:

[3] a volume fraction of void in the material including continuous and discontinuous phases is 5% or less; and

[4] the material including continuous phase and discontinuous phase having a crosslinking agent with an average particle size of 10 μm or less is compacted into a specific shape through a magnetic field press at 50 MPa or less.

2. The anisotropic rare earth-iron based resin bonded magnet according to claim 1, wherein $HcJp_N$ is 1 to 1.25 MA/m while $HcJp_s$ is equal to or less than $HcJp_N$ when coercivity of the spherical $Sm_2Fe_{17}N_3$ based magnetic material is $HcJp_s$, and coercivity of the $Nd_2Fe_{14}B$ based magnetic material at a room temperature is $HcJp_N$.

3. The anisotropic rare earth-iron based resin bonded magnet according to claim 1, wherein $HcJp_N$ is 1 to 1.25 MA/m while α is 0.75 or less when coercivity of the spherical $Sm_2Fe_{17}N_3$ based magnetic material is $HcJp_s$, coercivity of the $Nd_2Fe_{14}B$ based magnetic material at a room temperature is $HcJp_N$, and a ratio between $HcJp_s$ and $HcJp_N$ ($HcJp_s/HcJp_N$) is α.

4. The anisotropic rare earth-iron based resin bonded magnet according to claim 1, wherein $HcJp_N$ is 1 to 1.25 MA/m while α is 0.65 or less when coercivity of the spherical $Sm_2Fe_{17}N_3$ based magnetic material is $HcJp_s$, coercivity of the $Nd_2Fe_{14}B$ based magnetic material at a room temperature is $HcJp_N$, and a ratio between $HcJp_s$ and $HcJp_N$ ($HcJp_s/HcJp_N$) is α.

5. The anisotropic rare earth-iron based resin bonded magnet according to claim 1, wherein $Vf_p$ is equal to or larger than 80 vol. % while an orientation degree of the magnetic material $Mr_M/(Mrp \times Vf_p)$ is 0.96 or more where the symbols $Mr_M$, $Mr_p$, and $Vf_p$ are remanence of the resin bonded magnet, remanence of the mixed $Sm_2Fe_{17}N_3$ and the $Nd_2Fe_{14}B$ magnetic material, and a volume fraction of magnetic material in the resin bonded magnet, respectively.

6. The anisotropic rare earth-iron based resin bonded magnet according to claim 1, wherein the maximum energy product $(BH)_{max}$ at a room temperature is 170 kJ/m$^3$ or more.

7. The anisotropic rare earth-iron based resin bonded magnet according to claim 1, wherein $Vf_p$ is equal to or larger than 80 vol. % while an orientation degree of the magnetic material $Mr_M/(Mrp \times Vf_p)$ is 0.98 or more where the symbols $Mr_M$, $Mr_p$ and $Vf_p$ are remanence of the resin bonded magnet, remanence of the mixed $Sm_2Fe_{17}N_3$ and the $Nd_2Fe_{14}B$ magnetic material, and a volume fraction of magnetic material in the resin bonded magnet, respectively.

8. The anisotropic rare earth-iron based resin bonded magnet according to claim 1, wherein the maximum energy product $(BH)_{max}$ at a room temperature is 180 kJ/m$^3$ or more.

9. The anisotropic rare earth-iron based resin bonded magnet according to claim 1, wherein $Hk/HcJ_{RT}$ is less than $Hk/HcJ_{100}$ when a squareness at a room temperature is $Hk/HcJ_{RT}$, and a squareness at a temperature of 100° C. is $Hk/HcJ_{100}$, where Hk is a magnetic field in a demagnetization curve corresponding to 90% of remanence Mr, HcJ is coercivity, and squareness is calculated from Hk/HcJ.

* * * * *